United States Patent [19]

Ichijima et al.

[11] Patent Number: 4,770,982

[45] Date of Patent: Sep. 13, 1988

[54] SILVER HALIDE PHOTOGRAPHIC MATERIALS CONTAINING A COMPOUND WHICH RELEASES A PHOTOGRAPHICALLY USEFUL GROUP

[75] Inventors: Seiji Ichijima; Shigeo Hirano; Koki Nakamura; Keiji Mihayashi, all of Kanagawa, Japan

[73] Assignee: Fuji Photo Film Co., Ltd., Kanagawa, Japan

[21] Appl. No.: 870,581

[22] Filed: Jun. 4, 1986

[30] Foreign Application Priority Data

Jun. 4, 1985 [JP] Japan ..... 60-121285

[51] Int. Cl.[4] ..... G03C 1/46; G03C 7/30; G03C 7/32; G03C 7/26

[52] U.S. Cl. ..... 430/505; 430/223; 430/544; 430/553; 430/555; 430/557; 430/558; 430/564; 430/598; 430/607; 430/955; 430/956; 430/957; 430/958; 430/959

[58] Field of Search ..... 430/223, 955, 956, 957, 430/958, 959, 564, 598, 607, 544, 553, 555, 557, 558

[56] References Cited

U.S. PATENT DOCUMENTS

| | | | |
|---|---|---|---|
| 4,434,225 | 2/1984 | Sugita et al. | 430/544 |
| 4,482,629 | 11/1984 | Nakagawa et al. | 430/957 X |
| 4,490,459 | 12/1984 | Iijima et al. | 430/549 X |
| 4,618,571 | 10/1986 | Ichijima et al. | 430/958 X |

*Primary Examiner*—Mukund J. Shah

*Attorney, Agent, or Firm*—Sughrue, Mion, Zinn, Macpeak, and Seas

[57] ABSTRACT

A silver halide photographic material is disclosed which contains a compound represented by formula (I)

$$\mathrm{RED}\text{-}(\text{-}L_1)_v\mathrm{B}\text{-}(\text{-}L_2)_w\mathrm{PUG} \qquad (I)$$

wherein RED represents a group adapted to release the group $(L_1)_v$B-$(L_2)_w$PUG upon oxidation: $L_1$ represents a group adapted to release the group B-$(L_2)_w$PUG after cleavage from RED; B represents a group which, after cleavage of the bond with $L_1$ or RED, releases the group $(L_2)_w$PUG upon reaction with an oxidized developing agent; $L_2$ represents a group which, after cleavage from B, releases PUG; PUG represents a photographically useful group; and v and w each represents 0 or 1.

21 Claims, No Drawings

SILVER HALIDE PHOTOGRAPHIC MATERIALS CONTAINING A COMPOUND WHICH RELEASES A PHOTOGRAPHICALLY USEFUL GROUP

BACKGROUND OF THE INVENTION

1. Field of the Invention

The present invention relates to silver halide photographic materials. More particularly, the present invention relates to a silver halide photographic materials containing a compound adapted to make available a photographically useful group in photographic development.

2. Description of the Prior Art

Compounds are known which are able to release photographically useful groups through oxidation-reduction reactions.

Examples include hydroquinone derivatives adapted to release development inhibitors, as described, e.g., in U.S. Pat. Nos. 3,379,529, 3,620,746, 4,144,071, 4,377,634 and 4,332,878.

Examples of hydroquinone derivatives which release silver halide solvents are described in U.S. Pat. No. 4,459,351.

Examples of hydroquinone derivatives adapted to release diffusible dyes are described in U.S. Pat. Nos. 3,698,897 and 3,725,062.

As described in the above-mentioned patents, the compounds heretofore known are used for various purposes depending on the types of their photographically useful groups. In color photographic light-sensitive materials, in particular, hydroquinone compounds adapted to release a development inhibitor have been used effectively for the improvement of sharpness, granularity, and color reproduction. However, in order to meet increasingly sophisticated and complex photographic requirements, the conventional compounds are not satisfactory and further improvements have been required.

Thus, it is undeniably true that in recently formulated high-sensitivity color photographic light-sensitive materials, sharpness and granularity have been more or less sacrificed in order to increase the sensitivity. Moreover, in the disk size film, which requires a high magnification factor for printing, graininess and sharpness have not been as satisfactory as desired.

In silver halide photographic materials for photoengraving use, compounds capable of providing further improvements in dot quality have been strongly desired.

Furthermore, in black-and-white photographic light-sensitive materials for X-ray use, materials conductive to improved sharpness have also been strongly desired.

SUMMARY OF THE INVENTION

The present invention, therefore, has as its object to provide a photographic light-sensitive material having improved image qualities, e.g., sharpness, granularity, and color reproduction, or having improved sensitivity.

The above object has been accomplished by a silver halide photographic material characterized by containing a compound represented by formula (I)

$$\text{RED}\text{-}(\text{L}_1)_v\text{B}\text{-}(\text{L}_2)_w\text{PUG} \qquad \text{(I)}$$

wherein RED represents a group adapted to release the group $(L_1)_v B\text{-}(L_2)_w PUG$ upon oxidation: $L_1$ represents a group adapted to release the group $B\text{-}(L_2)_w PUG$ after cleavage from RED; B represents a group which, after cleavage of the bond with $L_1$ or RED, releases the group $(L_2)_w PUG$ upon reaction with an oxidized developing agent; $L_2$ represents a group which, after cleavage from B, releases PUG; PUG represents a photographically useful group; and v and w each represents 0 or 1.

DETAILED DESCRIPTION OF THE INVENTION

The reaction process through which a compound of formula (I) releases PUG in the course of development is shown by the following reaction scheme.

$$\text{RED}\text{-}(\text{L}_1)_v\text{B}\text{-}(\text{L}_2)_w\text{PUG} \xrightarrow{\text{T}^{\oplus}}$$

$$(\text{L}_1)_v\text{B}\text{-}(\text{L}_2)_w\text{PUG} \longrightarrow \text{B}\text{-}(\text{L}_2)_w\text{PUG} \xrightarrow{\text{T}^{\oplus}}$$

$$(\text{L}_2)_w\text{PUG} \longrightarrow \text{PUG}$$

wherein RED, $L_1$, B, $L_2$, PUG, v, and w have the same meanings as defined above for formula (I); $T^{\oplus}$ represents an oxidized developing agent.

Referring to the above reaction scheme, the reaction which yields $(L_2)_w PUG$ from $B\text{-}(L_2)_w PUG$ characterizes the present invention. This reaction is a secondary reaction between $T^{\oplus}$ and $B\text{-}(L_2)_w PUG$. In other words, the velocity of this reaction is dependent on the relative concentrations of these two entities. When a large amount of $T^{\oplus}$ is available, $B\text{-}(L_2)_w PUG$ gives rise to $(L_2)_w PUG$ instantly, whereas $B\text{-}(L_2)_w PUG$ is slow to yield $(L_2)_w PUG$ where the production of $T^{\oplus}$ is not profuse. It is presumed that this reaction step, coupled with the other reaction steps in the above reaction scheme, leads to an effective manifestation of the action of PUG, and, hence, results in the beneficial effects obtained in accordance with the present invention.

Referring now in more detail to formula (I), the group represented by RED is preferably a group represented by formula (II)

$$\text{A}_1\text{—P}\text{-}(\text{X}{=}\text{Y})_n\text{Q—A}_2 \qquad \text{(II)}$$

wherein P and Q each represents an oxygen atom or a substituted or unsubstituted imino group, and at least one of the n occurrences of X and the n occurrences of Y represents a methine group having $\text{-}(L_1)_v B\text{-}(L_2)_w PUG$ as a substituent, and the other occurrences of X and Y each represents a substituted or unsubstituted methine group or a nitrogen atom; n is an integer of 1 or 3 (the n occurrences of X and the n occurrences of Y may be the same or different); $A_1$ and $A_2$ each represents a hydrogen atom or a group capable of being removed with alkali. Included are cases in which any two of the substituent groups P, X, Y, Q, $A_1$ and $A_2$ are divalent groups which are jointed to form a cyclic structure.

When P and Q each represents a substituted or unsubstituted imino group, it is preferably an imino group substituted by a sulfonyl or acyl group.

In such cases, P and Q can be represented by $$\begin{array}{c} *\text{—N—}** \\ | \\ \text{SO}_2\text{—G} \end{array} \qquad \begin{array}{c} *\text{—N—}** \\ | \\ \text{CO—G} \end{array}$$

wherein * denotes the position of attachment to $A_1$ or $A_2$ and ** denotes the position of attachment to one of the available valences of $-(X=Y)_n-$.

In the above formulae, preferred examples of the group G are straight-chain or branched-chain, acyclic or cyclic, saturated or unsaturated, and substituted or unsubstituted aliphatic groups having from 1 to 32, and preferably from 1 to 22, carbon atoms (e.g., a methyl, ethyl, benzyl, phenoxybutyl and isopropyl group, etc.), substituted or unsubstituted aromatic groups having from 6 to 10 carbon atoms (e.g., a phenyl, 4-methylphenyl, 1-naphthyl and 4-dodecyloxyphenyl group, etc.), 4- or 7-membered heterocyclic groups in which the hetero atom or atoms are selected from nitrogen, sulfur, and oxygen atoms (e.g., a 2-pyridyl, 1-phenyl-4-imidazolyl, 2-furyl and benzothienyl group, etc.).

When $A_1$ and $A_2$ each represents a group capable of being removed with alkali (hereinafter referred to as a precursor group), such hydrolyzable groups as an acyl, alkoxycarbonyl, aryloxycarbonyl, carbamoyl, imidazolyl, oxazolyl and sulfonyl group, etc., precursor groups of the type utilizing the reverse Michael reaction as described in U.S. Pat. No. 4,009,029, precursor groups of the type wherein the anion generated on ring-opening reaction is utilized as an intramolecular nucleophilic group as described in U.S. Pat. No. 4,310,612, precursor groups such that an anion undergoes electron transfer along a conjugated system to thereby cause cleavage as described in U.S. Pat. Nos. 3,674,478, 3,932,480 and 3,993,661, precursor groups such that the electron transfer of the anion generated following the ring fission causes cleavage as described by U.S. Pat. No. 4,335,200, and precursor groups of the type wherein an imidomethyl group is utilized as described in U.S. Pat. Nos. 4,363,865 and 4,410,618.

Referring to formula (II), it is preferable that P and $A_2$ represent an oxygen atom and a hydrogen atom, respectively. More desirably, in formula (II), occurrences of X and Y, other than X or Y which is a methine group having $-(L_1)_v B-(L_2)_w PUG$ as a substituent, each represents a substituted or unsubstituted methine group.

Furthermore, the effects of the present invention are manifested especially well when RED in formula (I) is represented by formula (III) or (IV)

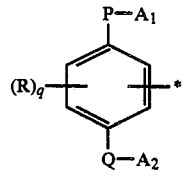

(III)

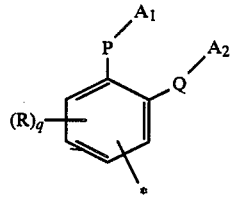

(IV)

wherein * denotes the position of attachment of $-(L_1)_v B(L_2)_w PUG$; and P, Q, $A_1$, and $A_2$ have the same meanings as defined for formula (II). R represents a substituent group and "q" represents an integer of 0 to 3. When q is 2 or more, two or more occurrences of R can represent the same or different species. When two occurrences of R represent divalent substituents on adjacent carbon atoms, they may be cyclized therebetween to form a benzene fused ring structure such as naphthalenes, benzonorbornenes, chromans, benzothiophenes, quinolines, benzofurans, 2,3-dihydrobenzofurans, indanes or indenes. The ring so formed may respectively have one or more further substituent groups. Preferred examples of such substituent groups in cases of fused rings having further substituents, and preferred examples of R in cases in which R does not form a fused ring include aliphatic groups (e.g., a methyl, ethyl, aryl, benzyl and dodecyl group), aromatic groups (e.g., a phenyl, naphthyl and 4-phenoxycarbonylphenyl group), halogen atoms (e.g., a chlorine and bromine atom), alkoxy groups (e.g., a methoxy, hexadecyloxy group), alkylthio groups (e.g., a methylthio, dodecylthio and benzylthio group), aryloxy groups (e.g., a phenoxy, 4-t-octylphenoxy and 2,4-di-t-amylphenoxy group), arylthio groups (e.g., a phenylthio and 4-dodecyloxyphenylthio group), carbamoyl groups (e.g., an N-ethylcarbamoyl, N-hexadecylcarbamoyl, N-3-(2,4-di-t-amylphenoxy)propylcarbamoyl and N-methyl-N-octadecylcarbamoyl group), alkoxycarbonyl groups (e.g., a methoxycarbonyl, ethoxycarbonyl, dodecyloxycarbonyl and 3-(2,4-di-t-amylphenoxy)propoxycarbonyl group), aryloxycarbonyl groups (e.g., a phenoxycarbonyl and 4-nonylphenoxycarbonyl group), sulfonyl groups (e.g., a methanesulfonyl, benzenesulfonyl, and p-toluenesulfonyl group), sulfamoyl groups (e.g., an N-propylsulfamoyl, N-methyl-N-octadecylsulfamoyl, N-phenylsulfamoyl and N-dodecylsulfamoyl group), acylamino groups (e.g., an acetamido, benzamido, tetradecanamido, 4-(2,4-di-t-amylphenoxy)butanamido, 2-(2,4-di-ti-amylphenoxy)butanamido and 2-(2,4-di-t-amylphenoxy)tetradecanamido group), sulfonamido groups (e.g., a methanesulfonamido, benzenesulfonamido, and hexadecylsulfonamido group), acyl groups (e.g., an acetyl, benzoyl, myristoyl, and palmitoyl group), nitroso group, acyloxy groups (e.g., an acetoxy, benzoyloxy, and lauryloxy group), ureido groups (e.g., a 3-phenylureido and 3-(4-cyanophenyl)ureido group), nitro groups, cyano groups, heterocyclic groups (4- to 6-membered heterocyclic ring in which the hetero atom or atoms are selected from among nitrogen, oxygen, and sulfur atoms (e.g., a 2-furyl, 2-pyridyl, 1-imidazolyl, 1-morpholino group)), hydroxy groups, carboxyl groups, sulfo groups, alkoxycarbonylamino groups (e.g., a methoxycarbonylamino, phenoxycarbonylamino, and dodecyloxycarbonylamino group), amino groups, arylamino groups (e.g., an anilino and 4-methoxycarbonylanilino group), aliphatic amino groups (e.g., an N,N-diethylamino and dodecylamino group), sulfinyl groups (e.g., a benzenesulfinyl and propylsulfinyl group), sulfamoylamino groups (e.g., a 3-phenylsulfamoylamino group), thioacyl groups (e.g., a thiobenzoyl group), thioureido groups (e.g., a 3-phenylthioureido group), heterocyclic thio groups (e.g, a thiadiazolyl group), imido groups (e.g., a succinimido, phthalimido and octadecenylimido group) and heterocyclic amino groups (e.g., a 4-imidazolylamino and 4-pyridylamino group).

When any of the above-mentioned substituents contains an aliphatic group, such aliphatic moiety typically contains from 1 to 32 carbon atoms, and preferably from 1 to 20 carbon atoms, and may be acyclic or cyclic, straight-chain or branched-chain, saturated or unsaturated, and substituted or unsubstituted.

When any of the above-mentioned substituents has an aromatic group, such aromatic group contains from 6 to 10 carbon atoms, and is preferably a substituted or unsubstituted phenyl group.

Among the RED moieties represented by formulae (III) and (IV), those represented by formulae (V) and (VI) are particularly desirable. These RED moieties feature a high rate of cleavage of $-(L_1)_v B-(L_2)_w PUG$ and a high stability of the compounds.

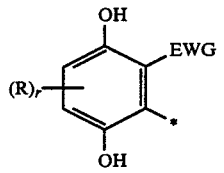
(V)

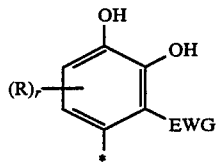
(VI)

In the formulae, * denotes the position of attachment of $-(L_1)_v B(L_2)_w PUG$; R has the same meaning as defined for formulae (III) and (IV); "r" represents 0, 1 or 2; and EWG represents an electron-attractive substituent group. When "r" is equal to 2 and the two occurrences of R represent adjacent substituents, these substituents may form a fused ring structure, as explained in reference to formulae (III) and (IV).

The electron-attractive group EWG is particularly preferably a substituent group having a Hammett's $\sigma$ para value of at least 0.3. Preferred examples of EWG are a cyano group, a nitro group, a substituted or unsubstituted carbamoyl group having from 1 to 30 carbon atoms, a substituted or unsubstituted sulfamoyl group having from 1 to 30 carbon atoms, a substituted or unsubstituted sulfonyl group having from 1 to 30 carbon atoms, a substituted or unsubstituted alkoxycarbonyl group having from 1 to 30 carbon atoms, a substituted or unsubstituted phenoxycarbonyl group, a substituted or unsubstituted acyl group having from 1 to 30 carbon atoms, a perfluoroalkyl group having from 1 to 10 carbon atoms (e.g., a trifluoromethyl group), a substituted or unsubstituted heterocyclic group having from 1 to 30 carbon atoms, and so on.

The groups $L_1$ and $L_2$ in formula (I) need not necessarily be used in the practice of the present invention, and may be suitably selected according to the particular purpose intended. The groups $L_1$ and $L_2$ are preferably known linking groups as noted below, for instance:

(1) Groups which utilize the hemiacetal cleavage reaction. For example, such groups are described in U.S. Pat. No. 4,146,396 and Japanese Patent Application (OPI) Nos. 60-249148, 60-241929, and 60-218645 (the term "OPI" used herein means "published unexamined Japanese patent application"), and may be represented by the formula set forth below. In the formula, * denotes the position of attachment at the left-hand side of formula (I), and ** denotes the position of attachment at the right-hand side of formula (I).

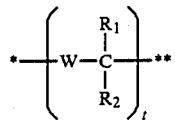

In the above formula, W represents an oxygen atom or a group

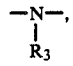

wherein $R_3$ represents an organic substituent group such as an acyl group (e.g., an acetyl group and a benzoyl group), a sulfonyl group (e.g., a methanesulfonyl group and a benzenesulfonyl group), an aliphatic group (e.g., a methyl group and an ethyl group), and a carbamoyl group (e.g., an ethylcarbamoyl group and a phenylcarbamoyl group); $R_1$ and $R_2$ each represents a hydrogen atom or a substitutent group such as an acyl group (e.g., a benzoyl group and an acetyl group), a carbamoyl group (e.g., N-ethylcarbamoyl group and N-phenylcarbamoyl group), and an aliphatic group (e.g., a methyl group and a butyl group); t represents 1 or 2, and when t is 2, the two occurrences of each of $R_1$ and $R_2$ can represent the same or different groups. Included are the case in which any two of $R_1$, $R_2$, and $R_3$ are combined to form a cyclic structure. In such cases, the typical example of the linking group represented by the above formula is mentioned below. In the following formula, $R_1'$ preferably represents an aliphatic group having from 1 to 5 carbon atoms (e.g., a methyl group, an ethyl group and a butyl group) or a hydrogen atom. The symbols * and ** denote the same meanings as in the above formula.

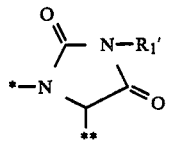

(2) Groups wherein cleavage is induced by intramolecular nucleophilic substitution reaction. Examples are the timing groups described in U.S. Pat. No. 4,248,962.

(3) Groups such that cleavage is induced by electron transfer along a conjugated system. Examples include the groups described in U.S. Pat. No. 4,409,323 and the groups of the following formula (which are groups described in British Pat. No. 2,096,783A).

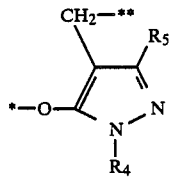

In the above formula, * denotes the position of attachment of the left-hand side in formula (I), and ** denotes the position of attachment at the righ-hand side in the general formula (I); and $R_4$ and $R_5$ each represents a hydrogen atom or a substituent group.

In the case in which $R_4$ represents a substituent group, preferable examples thereof include an aliphatic group (e.g., a methyl group and a benzyl group) and an aromatic group (e.g., a phenyl group and a 2,4,6-trichlorophenyl group). In the case in which $R_5$ represents a substituent group, preferable examples thereof include an aliphatic group (e.g., a methyl group, and an ethyl group), an aromatic group (e.g., a phenyl group and a 4-methoxyphenyl group), and an alkoxycarbonyl group (e.g., a methoxycarbonyl group and an ethoxycarbonyl group).

Referring to formula (I), B is a group, which after cleavage from RED-(-$L_1$)$_v$, becomes a coupler or undergoes redox reaction with an oxidation product (for example, an oxidized developing agent) available during development.

When B represents a group which provides a coupler, it is preferably a group represented by one of the following formulae (Cp-1), (Cp-2), (Cp-3), (Cp-4), (Cp-5), (Cp-6), (Cp-7), (Cp-8), (Cp-9), (Cp-10), and (Cp-11).

(Cp-1)

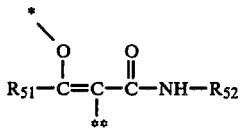

(Cp-2)

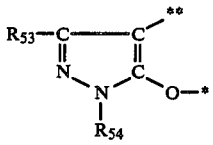

(Cp-3)

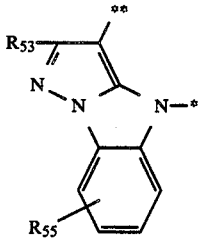

(Cp-4)

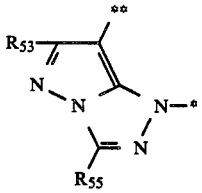

(Cp-5)

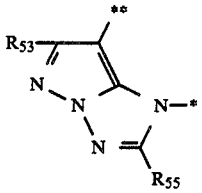

(Cp-6)

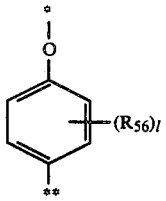

-continued (Cp-7)

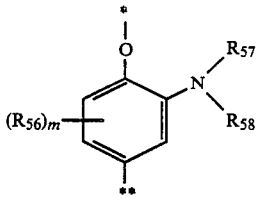

(Cp-8)

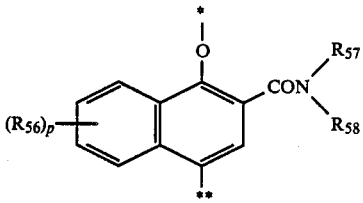

(Cp-9)

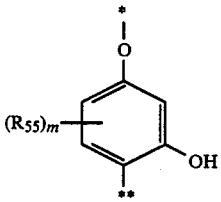

(Cp-10)

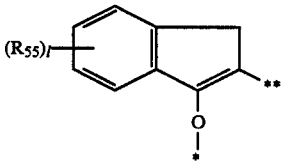

(Cp-11)

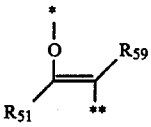

In the above formulae, * denotes the position of attachment to RED-(-$L_1$)$_v$ and ** denotes the position of attachment of ($L_2$)$_w$PUG, which is a coupling-off group.

In the above formulae, $R_{51}$, $R_{52}$, $R_{53}$, $R_{54}$, $R_{55}$, $R_{56}$, $R_{57}$, $R_{58}$ and $R_{59}$ are respectively selected so that the total number of carbon atoms in each formula is not more than 32, and preferably not more than 15.

$R_{51}$ through $R_{59}$, l, m, and p in the above formulae (Cp-1) through (Cp-11) are explained below in more detail.

$R_{51}$ represents an aliphatic aromatic, or heterocyclic group, and $R_{52}$ represents an aromatic or heterocyclic group.

The aliphatic group $R_{51}$ preferably has from 1 to 15 carbon atoms and is either substituted or unsubstituted, and acyclic or cyclic. Preferred substituents on the alkyl group represented by $R_{51}$ include alkoxy, aryloxy, amino and acylamino groups, and halogen atoms, and these substituents may further have one or more substituents thereon (except for the halogen atoms). Useful examples of the aliphatic group $R_{51}$ include an isopropyl, isobutyl, tert-butyl, isoamyl, tert-amyl, 1,1-dimethylbutyl, 1,1-dimethylhexyl, 1,1-diethylhexyl, dodecyl, cyclohexyl, 2-methoxyisopropyl, 2-phenoxyisopropyl, α-(diethylamino)isopropyl, α-(succinimido)isopropyl, α-(phthalimido)isopropyl and α-(benzenesulfonamido)isopropyl group, and so on.

When $R_{51}$ or $R_{52}$ is an aromatic group (especially a phenyl group), this aromatic group may have one or more substituents. Thus, the aromatic group, such as a phenyl group, may be substituted by an alkyl, alkenyl, alkoxy, alkoxycarbonyl, alkoxycarbonylamino, aliphatic amido, alkylsulfamoyl, alkylsulfonamido, alkylureido, or alkyl-substituted succinimido group each having at most 15 carbon atoms, and the alkyl groups may be interrupted by an aromatic group such as a phenylene group. The phenyl group may further be substituted by an aryloxy, aryloxycarbonyl, arylcarbamoyl, arylamido, arylsulfamoyl, arylsulfonamido or arylureido group, and the aryl moiety of the above substituents may further be substituted by one or more alkyl groups, the total number of carbon atoms in such alkyl substituent or substituents being within the range of 1 to 15.

The phenyl group $R_{51}$ or $R_{52}$ may further be substituted by a halogen atom, an amino, hydroxy, carboxy, sulfo, nitro, cyano, or thiocyano group, which in turn may be substituted by lower alkyls containing from 1 to 6 carbon atoms.

$R_{51}$ or $R_{52}$ may be a substituent group formed by fusion of the phenyl group to another ring, such as a naphthyl, quinolyl, isoquinolyl, chromanyl, coumaranyl and tetrahydronaphthyl group, and so on. These substituents themselves may have substituents.

When $R_{51}$ or $R_{52}$ represents a heterocyclic group, the heterocyclic group is bound to the carbonyl carbon atom of the acyl group or the amide nitrogen atom of the α-acyl-acetamide through one of the carbon atoms constituting the heterocyclic group Such heterocyclic group is exemplified by thiophene, furan, pyran, pyrrole, pyrazole, pyridine, pyrazine, pyrimidine, pyridazine, indolizine, imidazole, thiazole, oxazole, triazine, thiadiazine, and oxazine. These heterocyclic groups may further have one or more substituents on the ring.

Referring to formula (Cp-2), $R_{54}$ represents a $C_{1-32}$ (i.e., containing from 1 to 32 carbon atoms), and preferably $C_{1-15}$, straight-chain or branched-chain alkyl group (e.g., a methyl, isopropyl, tert-butyl, hexyl and dodecyl group, etc.) or an alkenyl group (e.g., an allyl group, etc.), a cyclic alkyl group (e.g., a cyclopentyl, cyclohexyl and norbornyl group, etc.), an aralkyl group (e.g., a benzyl and β-phenylethyl group, etc.), or a cyclic alkenyl group (e.g., a cyclopentenyl and cyclohexenyl group, etc.). These groups may have one or more substituents such as a halogen atom, a nitro, cyano, aryl, alkoxy, aryloxy, carboxy, alkylthiocarbonyl, arylthiocarbonyl, alkoxycarbonyl, aryloxycarbonl, sulfo, sulfamoyl, carbamoyl, acylamino, diacylamino, ureido, urethane, thiourethane, sulfonamido, heterocyclic, arylsulfonyl, alkylsulfonyl, arylthio, alkylthio, alkylamino, dialkylamino, anilino, N-arylanilino, N-alkylanilino, N-acylanilino, hydroxyl and mercapto group, and so on.

Further, $R_{54}$ may be an aryl group (e.g., a phenyl, α- or β-naphthyl group, etc.). The aryl group may have one or more substituents, such as an alkyl, alkenyl, cyclic alkyl, aralkyl and cyclic alkenyl group, a halogen atom, a nitro, cyano, aryl, alkoxy, aryloxy, carboxyl, alkoxycarbonyl, aryloxycarbonyl, sulfo, sulfamoyl, carbamoyl, acylamino, diacylamino, ureido, urethane, sulfonamido, heterocyclic, arylsulfonyl, alkylsulfonyl, arylthio, alkylthio, alkylamino, dialkylamino, anilino, N-alkylanilino, N-arylanilino, N-acylanilino and hydroxyl group, and so on.

$R_{54}$ may be a heterocyclic group (for example, 5- to 6-membered heterocyclic or fused heterocyclic groups containing hetero atoms such as nitrogen, oxygen, and sulfur atoms, e.g., a pyridyl, quinolyl, furyl, benzothiazolyl, oxazolyl, imidazolyl and naphthoxazolyl group, etc.), a heterocyclic group substituted by one or more members of the substituents mentioned for the aforesaid aryl group, an aliphatic or aromatic acyl group, an alkylsulfonyl group, an arylsulfonyl group, an alkylcarbamoyl group, an arylcarbamoyl group, an alkylthiocarbamoyl group, or an arylthiocarbamoyl group.

$R_{53}$ represents a hydrogen atom, a $C_{1-32}$ and preferably $C_{1-15}$, straight-chain or branched-chain alkyl, alkenyl, cyclic alkyl, aralkyl, or cyclic alkenyl group (these groups may have substituents such as mentioned above for $R_{54}$), an aryl or heterocyclic group (these groups may have substituents such as mentioned above for $R_{54}$), an alkoxycarbonyl group (e.g., a methoxycarbonyl, ethoxycarbonyl and methoxyethoxycarbonyl group, etc.), an aryloxycarbonyl group (e.g., a phenoxycarbonyl and naphthoxycarbonyl group, etc.), an aralkyloxycarbonyl group (e.g., a benzyloxycarbonyl group, etc.), an alkoxy group (e.g., a methoxy, ethoxy and decyloxy group, etc.), an aryloxy group (e.g., a phenoxy and tolyloxy group, etc.), an alkylthio group (e.g., an ethylthio and dodecylthio group, etc.), an arylthio group (e.g., a phenylthio and α-naphthylthio group, etc.), a carboxyl group, an acylamino group (e.g., an acetylamino and benzamido group, etc.), a diacylamino group, an N-alkylacylamino group (e.g., an N-methylpropionamido group, etc.), an N-arylacylamino group (e.g., an N-phenylacetamido group, etc.), a ureido group (e.g., a ureido, N-arylureido and N-alkylureido group, etc.), a urethane group, a thiourethane group, an arylamino group (e.g., a phenylamino, N-methylanilino, diphenylamino, N-acetylanilino and 2-chloro-5-tetradecanamidoanilino group, etc.), an alkylamino group (e.g., a n-butylamino, methylamino and cyclohexylamino group, etc.), a cycloamino group (e.g., a piperidino and pyrrolidino group, etc.), a dialkylamino group (e.g., a dibutylamino and dibenzylamino group, etc.), a heterocyclic-amino group (e.g., a 4-pyridylamino and 2-benzoxazolylamino group, etc.), an alkylcarbonyl group (e.g., methylcarbonyl group, etc.), an arylcarbonyl group (e.g., a phenylcarbonyl group, etc.), a sulfonamido group (e.g., an alkylsulfonamido and arylsulfonamido group, etc.), a carbamoyl group (e.g., an ethylcarbamoyl, dimethylcarbamoyl, N-methylphenylcarbamoyl and N-phenylcarbamoyl group, etc.), a sulfamoyl group (e.g., an N-alkylsulfamoyl, N,N-dialkylsulfonamoyl, N-arylsulfamoyl, N-alkyl-N-arylsulfamoyl and N,N-diarylsulfamoyl group, etc.), a cyano group, a hydroxyl group, or a sulfo group.

$R_{55}$ represents a hydrogen atom or a $C_{1-32}$, and preferably $C_{1-15}$, straight-chain or branched-chain alkyl or alkenyl, cyclic alkyl, aralkyl, or cyclic alkenyl group. These groups may have one or more substituents such as those mentioned above for $R_{54}$.

Furthermore, $R_{55}$ may represent any of a cyano, alkoxy and aryloxy group, a halogen atom, a carboxy, alkoxycarbonyl, aryloxycarbonyl, acyloxy, sulfo, sulfamoyl, carbamoyl, acylamino, diacylamino, ureido, urethane, sulfonamido, arylsulfonyl, alkylsulfonyl, arylthio, alkylthio, alkylamino, dialkylamino, anilino, N-arylanilino, N-alkylanilino, N-acylanilino, acyl, and hydroxyl group.

$R_{56}$, $R_{57}$, and $R_{58}$ each represents a group used in the conventional four-equivalent phenol or a α-naphthol couplers. Thus, $R_{56}$ may, for example, be a hydrogen atom, a halogen atom, an alkoxycarbonylamino group, an aliphatic hydrocarbon group, a sulfonamido group, an N-arylureido group, an acylamino group, —O—$R_{60}$ or —S—$R_{60}$, whrein $R_{60}$ is an aliphatic hydrocarbon group, and when $R_{56}$ exists in 2 or more occurrences in the same molecule, they may be the same or different. The aliphatic hydrocarbon group may be substituted.

When these substituents contain an aryl group, the aryl group may have substituents such as those mentioned for $R_{54}$.

$R_{57}$ and $R_{58}$ include groups selected from among aliphatic hydrocarbon groups, aryl groups, and heterocyclic groups. Or one of $R_{57}$ and $R_{58}$ may be a hydrogen atom, and the groups mentioned above may have substituents. Moreover, $R_{57}$ and $R_{58}$ can together represent a nitrogen-containing heterocyclic nucleus.

The aliphatic hydrocarbon groups mentioned above may be either saturated or unsaturated, either straight-chain, branched-chain or cyclic, or either substituted or unsubstituted. Preferred examples are alkyl groups (e.g., a methyl, ethyl, propyl, isopropyl, butyl, t-butyl, isobutyl, dodecyl, cyclobutyl and cyclohexyl group, etc.), and alkenyl groups (e.g., an allyl and octenyl group, etc.). Examples of the aryl groups include a phenyl and naphthyl group and so on, and typical examples of said heterocyclic groups include a pyridinyl, quinolyl, thienyl, piperidyl and imidazolyl group and so on. Substituents which can be introduced into the aliphatic hydrocarbon group, the aryl group, or the heterocyclic group include halogen atoms, and a nitro, hydroxyl, carboxyl, amino, substituted amino, sulfo, alkyl, alkenyl, aryl, heterocyclic, alkoxy, aryloxy, arylthio, arylazo, acylamino, carbamoyl, ester, acyl, acyloxy, sulfonamido, sulfamoyl, sulfonyl, cyano, and morpholino groups.

In formulae (Cp-6) and (Cp-10), "l" represents an integer of 1 to 4, "m" an integer of 1 to 3, and "p" an integer of 1 to 5.

$R_{59}$ represents an arylcarbonyl group, an alkanoyl group having from 2 to 32, or preferably from 2 to 15, carbon atoms, an arylcarbamoyl group, an alkanecarbamoyl group having from 2 to 32, or preferably from 2 to 15, carbon atoms, an alkoxycarbonyl or aryloxycarbonyl group having from 2 to 32, or preferably from 2 to 15, carbon atoms, an alkylsulfonyl group having from 1 to 32, or preferably from 1 to 15, carbon atoms, an arylsulfonyl group, an aryl group, or a 5- to 6-membered heterocyclic group wherein the hetero atom or atoms are selected from among N, O, and S, e.g., a triazolyl, imidazolyl, phthalimido, succinimido, furyl, pyridyl, or benzotriazolyl group. These groups may have substituents such as hereinbefore described for $R_{54}$.

Among the above mentioned coupler groups, the yellow coupler group is preferably such that, in formula (Cp-1), $R_{51}$ represents a t-butyl group or a substituted or unsubstituted aryl group and $R_{52}$ represents a substituted or unsubstituted aryl group.

A preferred magenta coupler group is such that, in formula (Cp-2), $R_{53}$ represents an acylamino, cyclic amino, dialkylamino or arylamino group and $R_{54}$ represents a substituted aryl group; in formula (Cp-3), $R_{52}$ represents an acylamino or arylamino group and $R_{55}$ represents a hydrogen atom; or, in formulae (Cp-4) and (Cp-5), $R_{53}$ and $R_{55}$ each represents a straight-chain or branched-chain, alkyl, alkenyl, cyclic alkyl, aralkyl, or cyclic alkenyl group.

A preferred cyan coupler group is such that in formula (Cp-6), l represents 3, and $R_{56}$'s represent an acylamino or ureido group in the 2-position, an acylamino or alkyl group in the 5-position, and a hydrogen or chlorine atom in the 6-position or, in formula (Cp-8), p represents 1, $R_{56}$ represents a hydrogen atom or an acylamino, sulfonamido, or alkoxycarbonylamino group in the 5-position, $R_{57}$ represents a hydrogen atom, and $R_{58}$ represents a phenyl, alkyl, alkenyl, cyclic alkyl, aralkyl, or cyclic alkenyl group.

Preferred examples of black coupler groups are such that $R_{55}$ in formula (Cp-9) represents an acyl, alkoxycarbonyl, sulfonyl, or sulfamoyl group in the 2-position (assuming that *—O— is the 1-position).

A preferred colorless coupler group is such that in formula (Cp-10), $R_{55}$ represents an acylamino, sulfonamido, or sulfamoyl group.

When B in formula (I) represents a group which undergoes redox reaction, preferred is one having the formula (VII).

$$*\text{-}(P\text{-}(X'=Y')_n Q\text{-}A_2 \qquad \text{(VII)}$$

In the above formula, * denotes the position of attachment to RED-$(L_1)_v$; $A_2$, P, Q and n have the same meanings as defined in general formula (II); and at least one of the n occurrences of X' and the n occurrences of Y' represents a methine group having -$(L_2)_w$PUG as a substituent group, and the other occurrences of X' and Y' each represents a substituted or unsubstituted methine group or a nitrogen atom. Included are cases in which any two substituents of $A_2$, P, Q, X' and Y' are divalent groups forming a cyclic structure.

The preferred among those of formula (VII) are represented by the following formulae (VIII) and (IX).

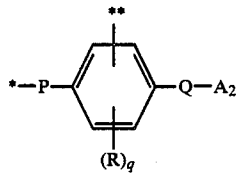

(VIII)

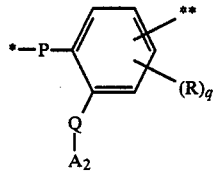

(IX)

wherein * denotes the position of attachment of RE-D-$(L_1)_v$; ** denotes the position of attachment of $(L_2)_w$PUG; and P, Q, $A_2$, R, and q have the same meanings as defined for formulae (III) and (IV).

In formulae (VIII) and (IX), it is particularly preferable that P and Q each represents an oxygen atom.

The photographically useful group PUG in formula (I) is preferably selected from among development inhibitors, development accelerators, silver halide solvents, dyes, fogging agents, developing agents, couplers, fixation accelerators, fixation retardants, and so on.

Examples of such photographically useful groups include the photographically useful groups described in U.S. Pat. No. 4,248,962 (i.e., the groups represented by PUG in said patent), and fogging agents as described in Japanese Patent Application (OPI) No. 170840/84 (i.e., the moiety of the cleavage group released from the coupler as described therein).

The fogging agents described in Japanese Patent Application (OPI) No. 170840/84 are represented by the following formula. In the formula, * denotes the position of attachment to $B\text{-}(L_2)_w$.

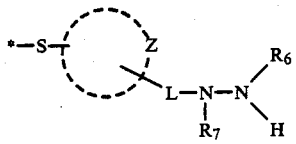

wherein Z represents a monocyclic or fused heterocyclic group comprising carbon and nitrogen atoms; L represents a divalent linking group; $R_7$ represents a hydrogen atom or an alkoxycarbonyl group; $R_6$ represents a hydrogen atom or an acyl, sulfonyl, alkoxycarbonyl, carbamoyl, sulfamoyl, thioacyl, thiocarbamoyl, alkyl, or aryl group. Among these PUG moieties, particularly preferred are development restraining groups such as a 5-aryltetrazolylthio, 5-aliphatic group-substituted tetrazolylthio, benzimidazolylthio, benzothiazolylthio, benzoxazolylthio, benzotriazolyl and benzoindazolyl group and so on.

Included are the cases in which said development inhibitors are substituted in their substitutable positions by the substituent groups mentioned for R (provided that the total number of carbon atoms in the substituents is not more than 22, and preferably not more than 10).

Referring to formula (I), the cases in which any two members optionally selected from the group RED, $L_1$, B, $L_2$ and PUG have valences in addition to the valences shown in general formula (I) and are linked together via such additional valences (bonds) are also encompassed by the present invention. The effects of the present invention are available even if these second valences or bonds are not cleaved at development. Examples of such bonds are as follows.

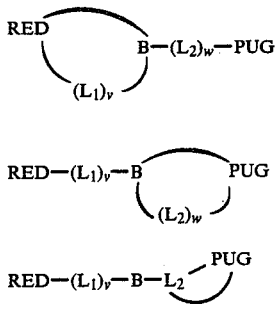

The effects of the compound according to the present invention are manifested particularly well in the following embodiments (1) through (4).

(1) The compound (I) according to the present invention can be applied to a multi-layer color photographic element comprising a support having thereon at least two-color-sensitive emulsion layers having different spectral sensitivities chiefly for the improvement of granularity, sharpness, color reproduction and sensitivity. The multi-layer color photographic material generally comprises a support having thereon at least one each of red-sensitive, green-sensitive, and blue-sensitive emulsion layers. The sequence of disposition of such layers in the element can be selected as required. Moreover, the compound according to the present invention can be incorporated in any desired layer such as a high sensitivity layer or an intermediate sensitivity layer and can be used either in a photosensitive silver halide emulsion layer or in a layer adjacent thereto.

The amount of addition of the compound according to the present invention depends on its structure and intended use. When PUG is a development inhibitor or a fogging agent, for instance, the amount of the compound is preferably in the range of from $1\times10^{-7}$ to $5\times10^{-1}$ moles, and more preferably is in the range of from $1\times10^{-6}$ to $1\times10^{-1}$ moles per mole of silver halide (in the form of photosensitive silver halide) associated therewith (i.e., present in the same and/or adjacent layer).

In the case of other kinds of PUG, the compound is preferably present in the range of from $1\times10^{-4}$ to $1\times10^{1}$ moles, and more preferably in the range of from $1\times10^{-3}$ to 1 mole, per mole of silver halide associated therewith.

The compound according to the present invention may be used singly in a given layer, or in conjunction with a known coupler in the same layer. When the compound of the present invention is used in combination with such a different image-forming coupler, the ratio of the former to the latter may generally range from 0.1/99.9 through 90/10, and preferably is from 1/99 through 50/50.

(2) The compound according to the present invention is effective in upgrading a silver halide photographic light-sensitive material for photoengraving use which comprises a silver chlorobromide or silver iodochlorobromide emulsion layer (preferably a mono-dispersed emulsion) containing at least 60 percent silver chloride and up to 5 percent silver iodide and further contains a polyalkylene oxide. When the PUG moiety of the compound (I) is a development inhibitor, for instance, it improves (lengthens) the screen gradient without adversely affecting the dot quality. Moreover, when PUG is a development accelerator, the compound according to the present invention contributes to increased sensitivity and improved dot quality. In these cases, the compound according to the present invention is generally used in the range of from $1\times10^{-7}$ moles to $1\times10^{-1}$ moles, and preferably from $1\times10^{-6}$ moles to $1\times10^{-2}$ moles, per mole of silver halide associated therewith.

(3) The compound of formula (I) according to the present invention is effective in improving (lengthening) the screen gradient, without adversely affecting the dot quality, of a photographic light-sensitive material having a mono-dispersed silver halide emulsion layer capable of forming an ultrahard negative image with the use of a stable developer solution through the action of a hydrazine derivative as described in U.S. Pat. Nos. 4,224,401, 4,168,977, 4,241,164, 4,311,781, 4,272,606, 4,221,857, 4,243,739, 4,272,614, and 4,269,929. In such applications, the compound according to the present invention is preferably a development inhibitor, and is generally used in the range of from $1\times10^{-5}$ moles to $8\times10^{-2}$ moles, and preferably from $1\times10^{-4}$ moles to $5\times10^{-2}$ moles, per mole of silver halide associated therewith.

(4) The compound of formula (I) according to the present invention, wherein B is not a coupler group, is effective in improving the photographic characteristics such as sharpness of a black-and-white photographic light-sensitive material, particularly for X-ray use, which comprises a support having on at least one side thereof a silver iodobromide or silver iodochlorobromide emulsion layer containing up to 50 mole percent silver chloride and up to 15 mole percent silver iodide. In such applications, the compound according to the present invention is preferably used in the range of from $1\times10^{-6}$ moles to $1\times10^{-1}$ moles, and preferably from $1\times10^{-5}$ moles to $5\times10^{-2}$ moles, per mole of silver halides associated therewith.

In addition to the above-mentioned varied uses, the compound of formula (I) according to the present invention can be applied to a variety of other photographic light-sensitive materials such as those for electron beam, high resolution black-and-white, diffusion transfer black-and-white, color X-ray, and diffusion transfer color photographic materials.

The following is an illustrative listing of compounds employed in the practice of the present invention. It should be understood that the present invention is by no means limited to the use of these specific compounds.

(1)

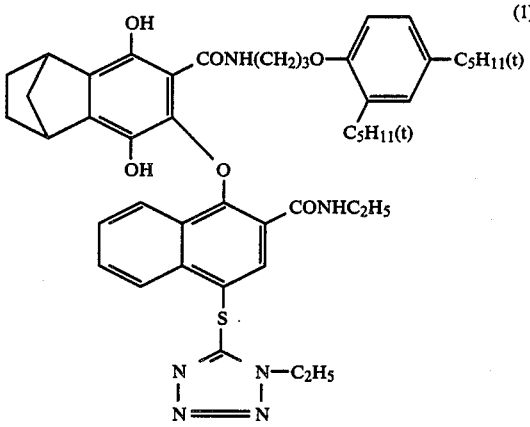

(2)

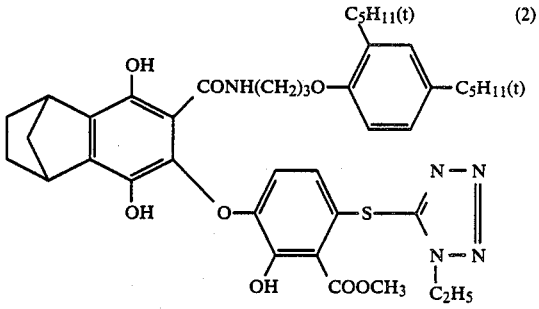

(3)

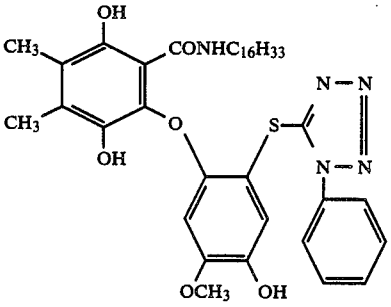

(4)

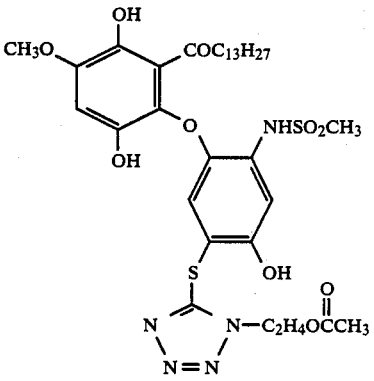

(5)

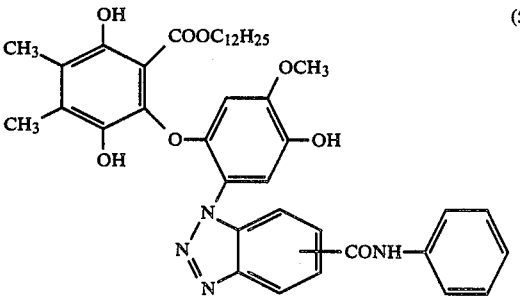

(6)

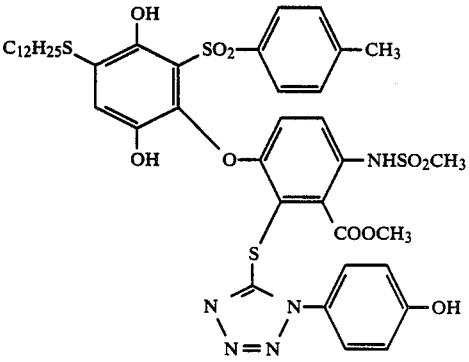

-continued
(7)
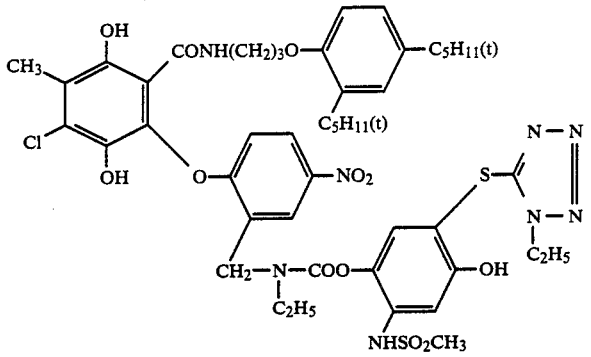
(8)
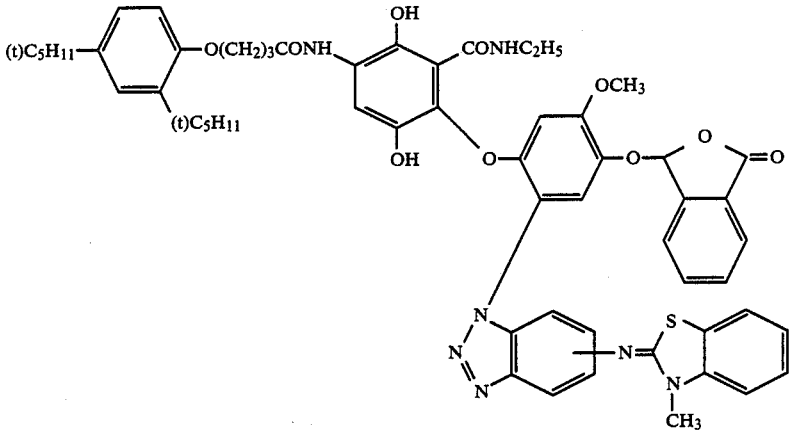
(9)
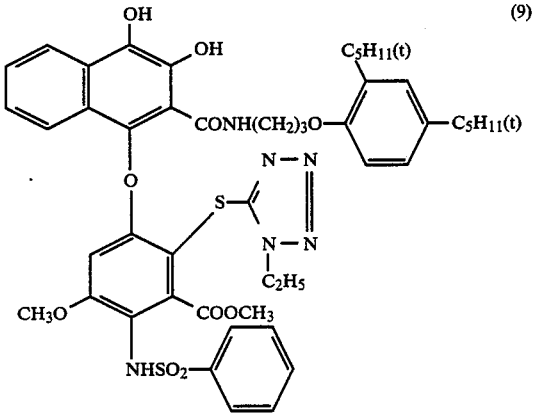
(10)
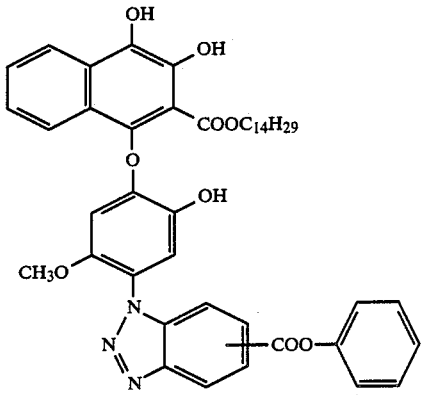
(11)
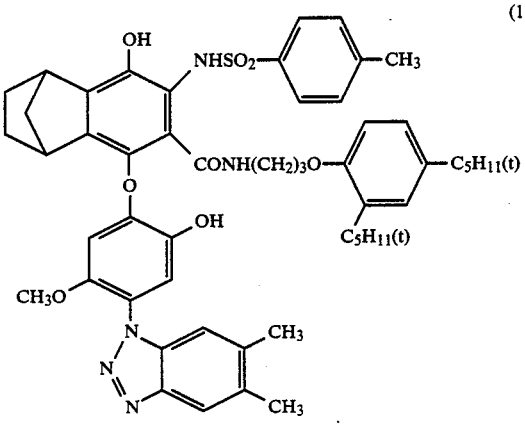
(12)
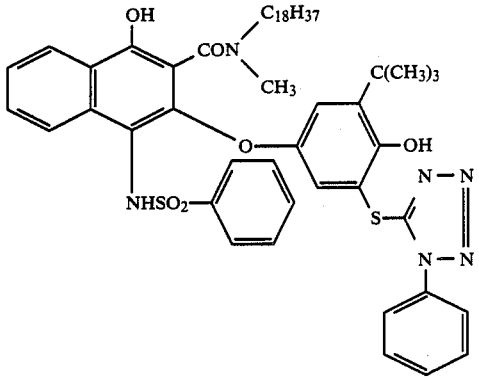

-continued
(13)
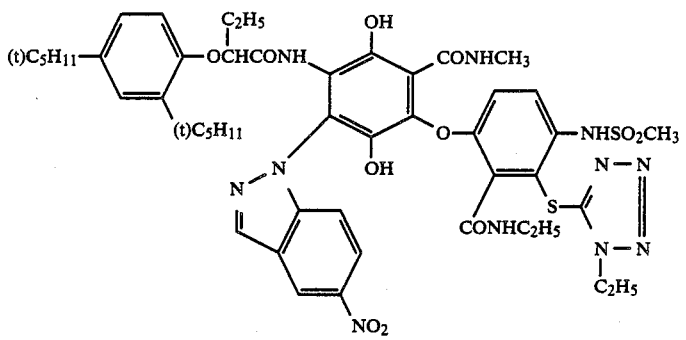
(14)
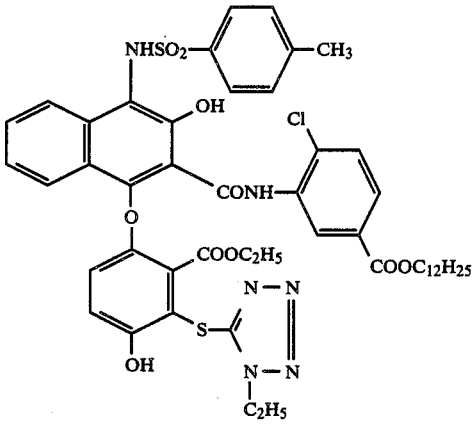
(15)
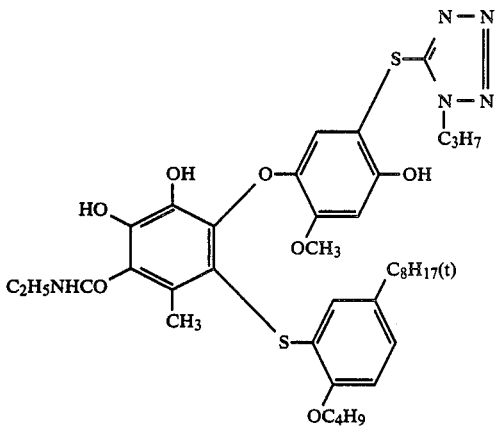
(16)
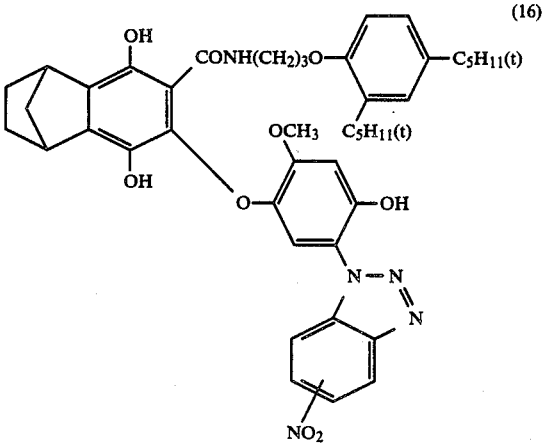
(17)
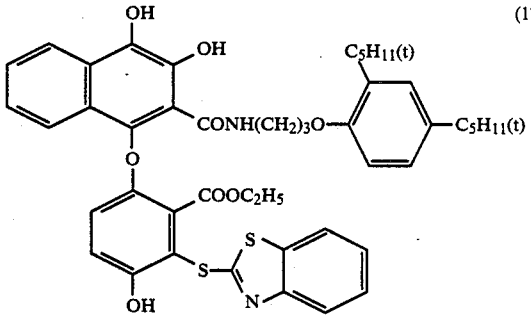

-continued
(18)
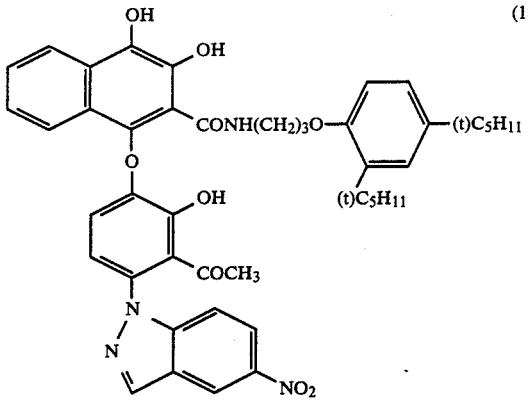
(19)
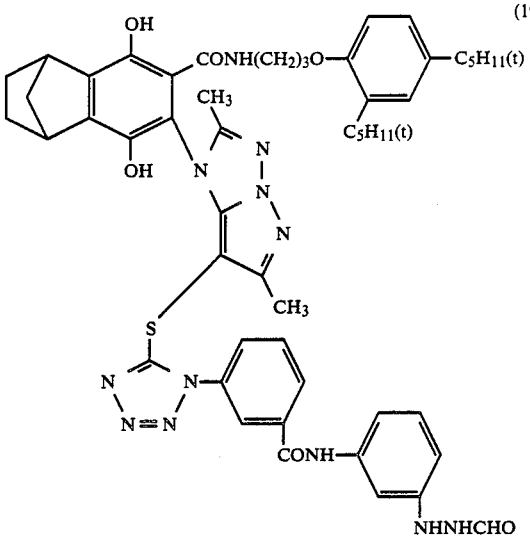
(20)
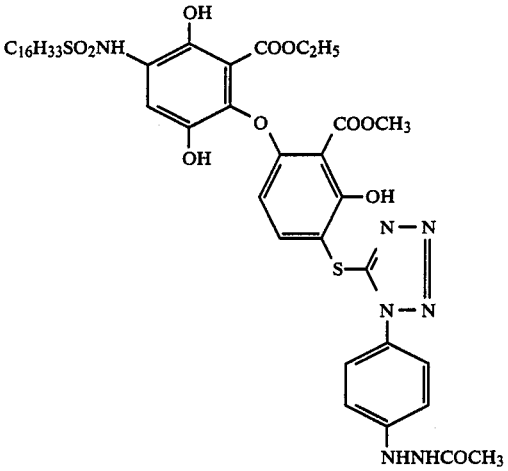
(21)
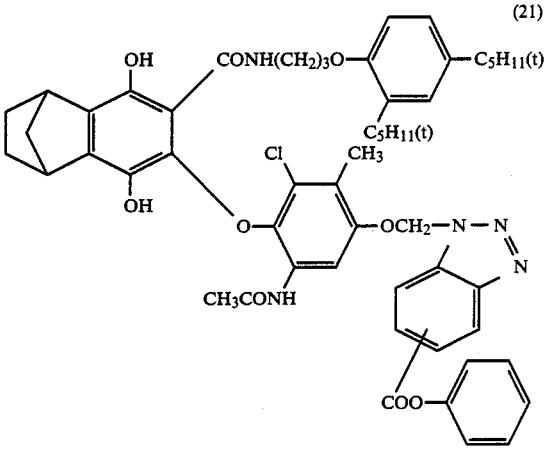
(22)
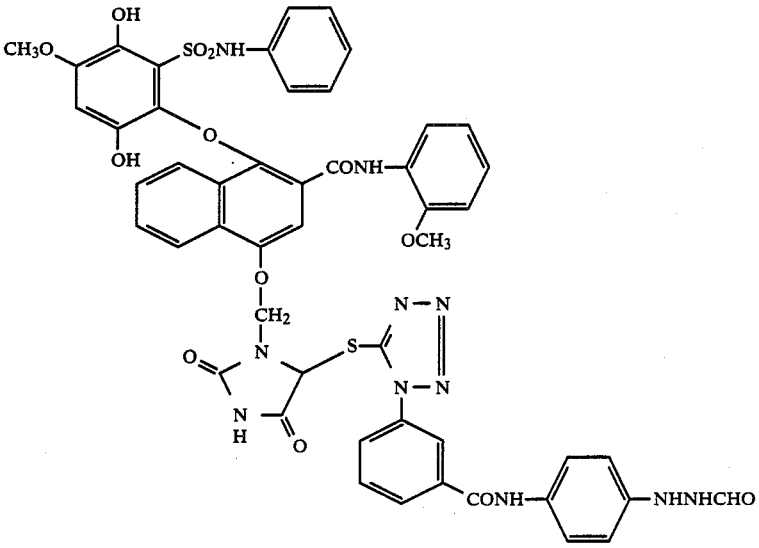

-continued
(23)
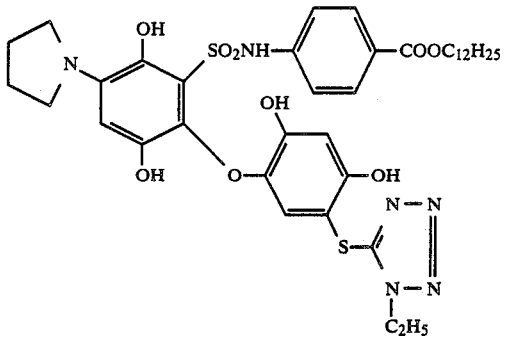
(24)
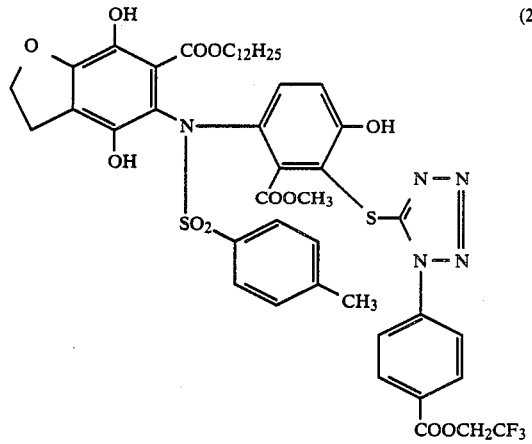
(25)
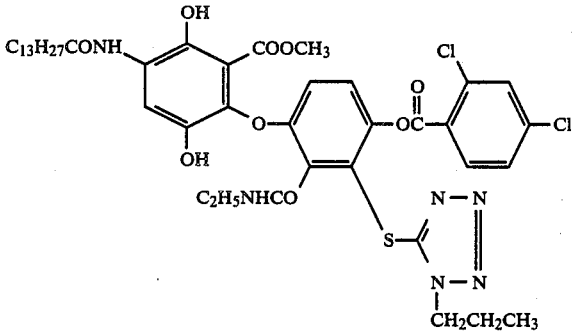
(26)
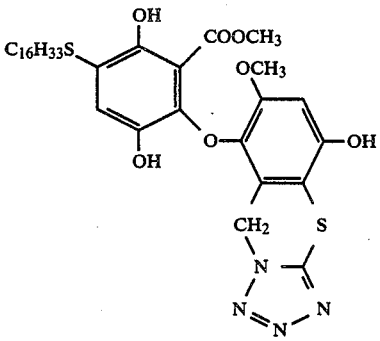
(27)
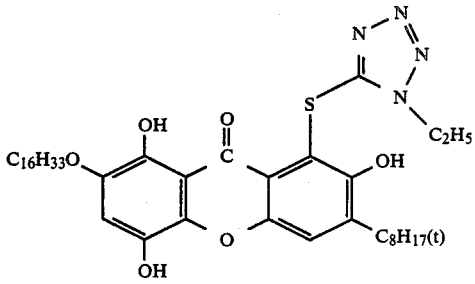
(28)
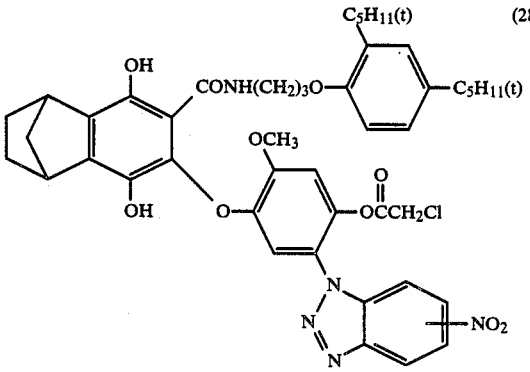
(29)
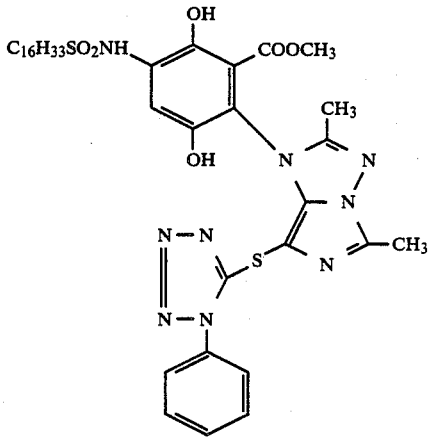

-continued
(30)
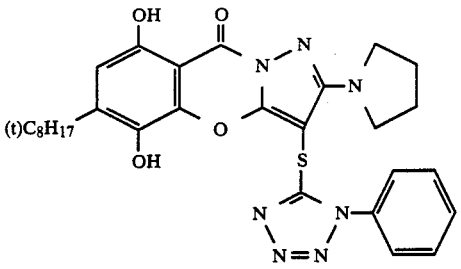
(31)
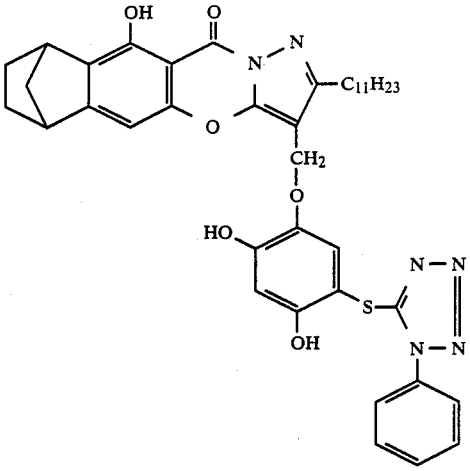
(32)
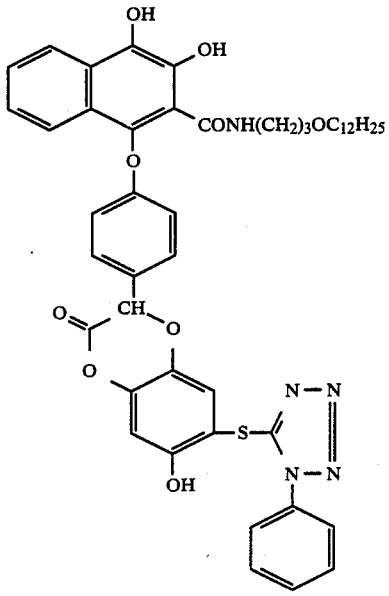
(33)
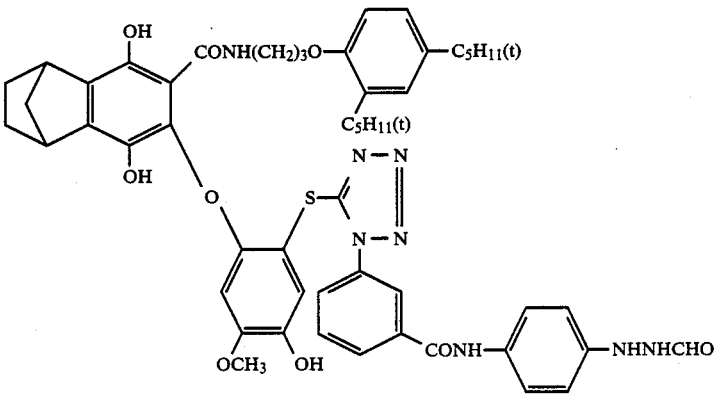

-continued
(34)
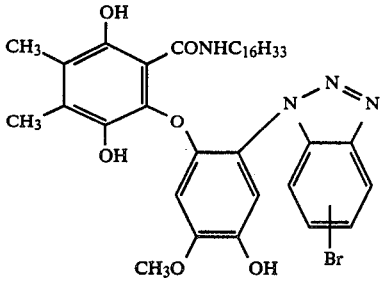
(35)
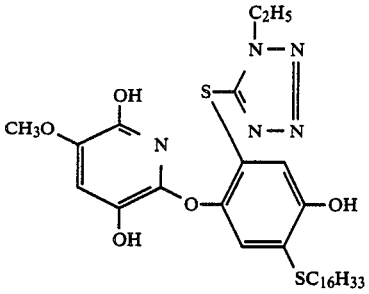
(36)
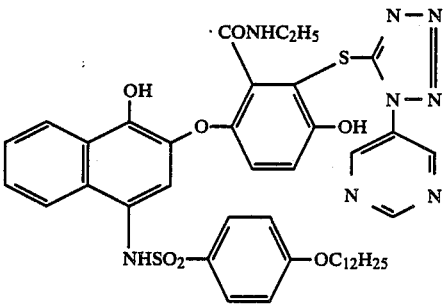
(37)
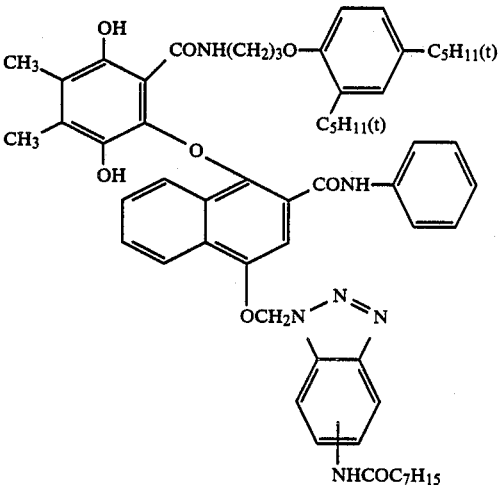
SYNTHESIS EXAMPLE 1
Synthesis of Compound (1):
Compound (1) was synthesized by the following procedures.
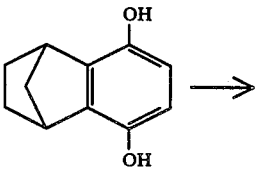
(i)
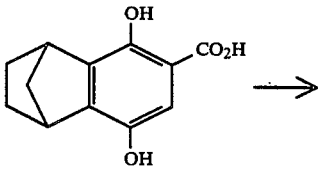
(ii)
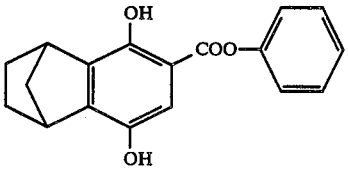
(iii)
-continued
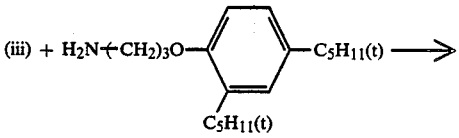
(iv)
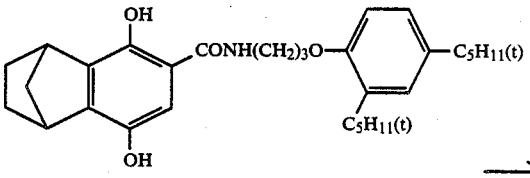
(v)
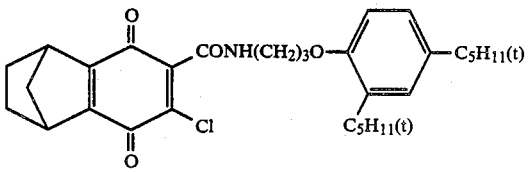
(vi)

-continued

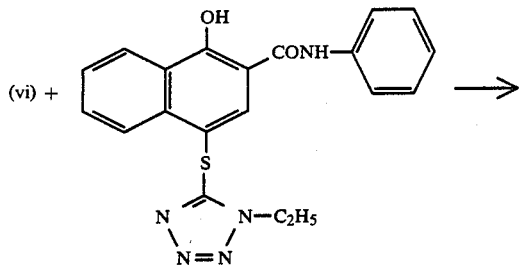

(vii)

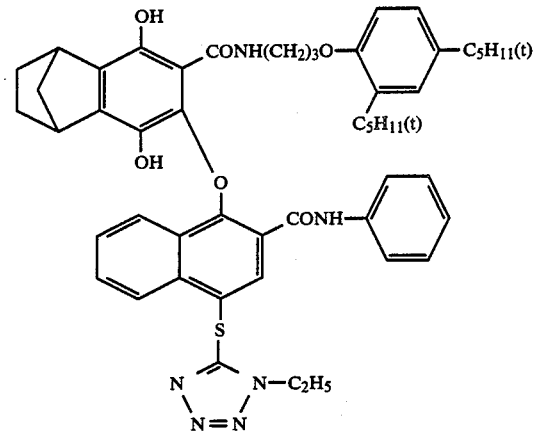

Compound (1)

(1) Synthesis of Compound (ii)

In N,N-dimethylformamide (400 ml) were dissolved 3,6-dihydroxybenzonorbornene (81.8 g) and potassium acetate (260 g). The solution was placed in an autoclave and heated at 180° C. in carbon dioxide at a pressure of 50 kg/cm$^2$. The reaction was continued at the same temperature for 8 hours. The reaction mixture was then cooled to room temperature and acidified with dilute hydrochloric acid. To this was added 1 l of ethyl acetate and the mixture was transferred to a separated funnel and extracted. The organic layer was washed with water and the solvent was distilled off under reduced pressure. To the residue was added warm water, followed by stirring to provide 92.1 g of Compound (ii).

(2) Synthesis of Compound (iii)

Compound (ii) was esterified by a conventional method (e.g., the method described in Japanese Patent Application (OPI) No. 28139/78) to provide Compound (iii).

That is, Compound (ii) was refluxed with phenol and thionyl chloride in equimolar amounts in benzene to produce Compound (iii). The yield of Compound (iii) is substantially 100%.

(3) Synthesis of Compound (v)

A mixture of Compound (iii) (74 g) and Compound (iv) (73 g) was heated at 140° C. at a reduced pressure of 20 mm Hg. The reaction was allowed to proceed for 4 hours, after which the reaction mixture was cooled to room temperature. The product was recrystallized from n-hexane to provide 75.5 g of Compound (v).

(4) Synthesis of Compound (vi)

Compound (v) (73.5 g) was dissolved in 800 ml of tetrahydrofuran and, at room temperature, 43.5 g of N-chlorosuccinimide was added to the solution. The reaction was allowed to proceed for 6 hours. The solvent was then distilled off and the residue was purified by silica gel column chromatography to provide 75 g of Compound (vi).

(5) Synthesis of Compound (1)

To a solution of 59.8 g of Compound (vi) in 500 ml of ethyl acetate were added 44.6 g of Compound (vii) and 23.9 g of potassium carbonate, and the reaction was allowed to proceed at room temperature for 4 hours. Then, the inorganic substance was filtered off and after cooling to 5° C. or below, an excess amount of aqueous solution of sodium hydrosulfite was added. The mixture was stirred vigorously, and, after 5 minutes, were acidified with a small amount of hydrochloric acid and then transferred to a separatory funnel, in which it was washed with water. The organic layer was separated and then dried over anhydrous sodium sulfate and the solvent was distilled off under reduced pressure. The residue was recrystallized from n-hexaneethyl acetate to provide 63.5 g of Compound (1).

SYNTHESIS EXAMPLE 2

Synthesis of Compound (3)

Compound (3) was synthesized by the following procedure.

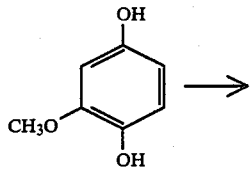

(viii)

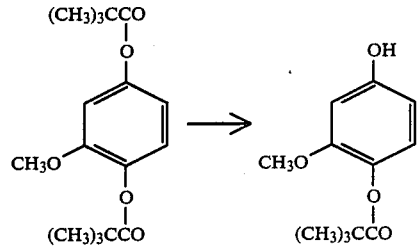

(ix) (x)

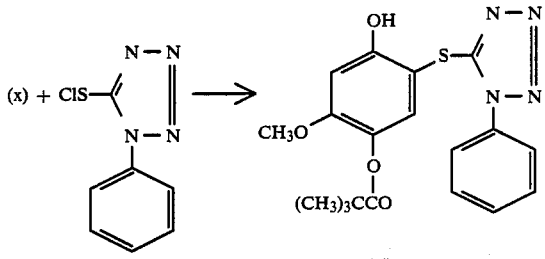

(xi)

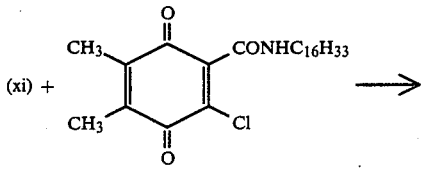

(xii)

-continued

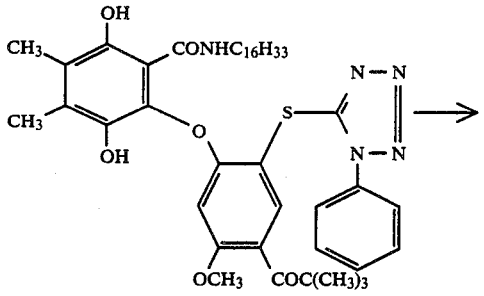

(xiii)

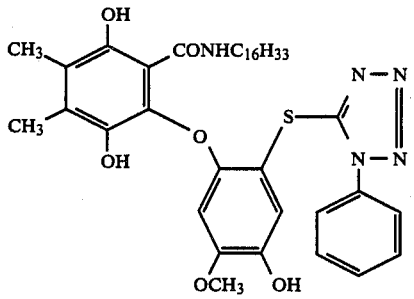

Compound (3)

(1) Synthesis of Compound (ix)

Methoxyhydroquinone (50 g) was mixed with ethyl acetate (50 ml), and nitrogen gas was bubbled into the mixture. Thereafter, 105 ml of triethylamine was added and the mixture was cooled to 10° C., followed by dropwise addition of 90.4 g of pivaloyl chloride. The reaction was allowed to proceed at the same temperature for 30 minutes, and the mixture was then transferred to a separatory funnel and washed with water. The organic layer was taken and dried over anhydrous sodium sulfate. The solvent was then concentrated to half its original volume. Hexane was added to the residue to provide 37.6 g of Compound (ix) as crystals.

(2) Synthesis of Compound (x)

Compound (ix) (37.6 g) was mixed with 200 ml of methanol and, after cooling to 5° C., a solution of 16 g of potassium hydroxide in 60 ml of methanol was added dropwise to the above solution. The reaction was allowed to proceed for 30 minutes, and 500 ml of ethyl acetate was added. The mixture was neutralized with dilute hydrochloric acid and then transferred to a separatory funnel, in which it was washed with water. The organic layer was taken and dried over anhydrous sodium sulfate. Finally, the solvent was distilled off under reduced pressure to provide 26 g of Compound (x) as an oil.

(3) Synthesis of Compound (xi)

To 100 ml of dichloromethane was added 21.2 g of 1-phenyl-5-mercaptotetrazole, followed by dropwise addition of sulfuryl chloride at 10° C. or below. The reaction was allowed to proceed for 30 minutes, and the solvent was distilled off under reduced pressure. To the residue was added 10 ml of dichloromethane and the resulting solution was added dropwise to a solution of 26 g of Compound (x) in 100 ml of acetonitrile at room temperature. The reaction was allowed to proceed for 1 hour and the mixture was transferred to a separatory funnel and washed with water. The organic layer was separated and then dried over anhydrous sodium sulfate. The solvent was then distilled off under reduced pressure and the residue was crystallized from ethyl acetate-hexane to provide 23.8 g of Compound (xi).

(4) Synthesis of Compound (xiii)

Using 23.8 g of Compound (xi), 26 g of Compound (xii) (synthesized in the same manner as Compound (vi) in Synthesis Example 1) and 10.6 g of potassium carbonate, the same procedure as described for synthesis of Compound (1) in Synthesis Example 1 (viz. Step (5) of Synthesis Example 1) was followed to provide 30.1 g of Compound (xiii).

(5) Synthesis of Compound (3)

In a solution of 12.3 g of potassium hydroxide in 150 ml of methanol was dissolved 30.1 g of Compound (xiii), and the reaction was allowed to proceed in a nitrogen gas atmosphere at room temperature for 2 hours. To the reaction mixture was added 500 ml of ethyl acetate and the mixture was neutralized with dilute hydrochloric acid and then transferred to a separatory funnel. The organic layer was separated, washed with water and dried on anhydrous sodium sulfate. The solvent was distilled off under reduced pressure and the residue was recrystallized from n-hexaneethyl acetate to provide 18.9 g of Compound (3).

The silver halide photographic light-sensitive material embodying the present invention may be a monochromatic color photographic light-sensitive material comprising a support having thereon one photosensitive silver halide emulsion layer or a multi-layer color photographic lightsensitive material comprising a support having thereon at least two different spectrally sensitized layers.

The multi-layer color photographic material generally comprises a film base or support having thereon at least one layer each of red-sensitive, green-sensitive and blue-sensitive emulsion layer units. The order of these layers is optional as desired. It is common practice to incorporate a cyan color-forming coupler in the red-sensitive emulsion layer, a magenta color-forming coupler in the green-sensitive emulsion layer, and a yellow color-forming coupler in the blue-sensitive emulsion layer, but other combinations may also be employed according to the intended purpose.

In the same or different photographic emulsion layers or light-insensitive layers of the color photographic photosensitive material according to the present invention, there may be incorporated, together with compounds of formula (I) mentioned hereinbefore, the so-called color couplers adapted to develop colors on oxidative coupling with an aromatic primary amine developing agent (for example, phenylenediamine derivatives, aminophenol derivatives, etc.) in the color development process.

In the silver halide multi-layer color photographic material embodying the present invention, yellow-, magenta- and cyan-forming couplers are generally employed and the couplers according to the present invention may be used for all of the three colors. If necessary, the couplers according to the present invention may be partially replaced with the hitherto-known color couplers.

For the purposes of the present invention, useful color couplers are cyan, magenta, and yellow couplers and as typical examples of such couplers, there may be mentioned naphthol or phenol compounds, pyrazolone, or pyrazoloazole compounds, and open-chain or heterocyclic ketomethylene compounds. Specific examples of such cyan, magenta, and yellow couplers that can be employed in the practice of the present invention are described in the patent literature referred to in *Research Disclosure,* RD Nos. 17643 (December 1978, VII-D) and 18717 (November 1979).

The color couplers incorporated in the light-sensitive material are preferably rendered non-diffusing either by means of ballast groups or by way of polymerization. Higher sensitivity and greater savings in silver can be obtained with a two-equivalent color coupler substituted by a coupling off group than with a four-equivalent color coupler having a hydrogen atom in the coupling position. Couplers giving rise to dyes possessing controlled diffusibility, non-color-forming couplers, DIR couplers adapted to release development inhibitors in association with coupling reaction, or couplers adapted to release development accelerators may also be utilized.

The yellow coupler suitable for the purposes of the present invention is typically exemplified by acylacetamide couplers of the oil protect type. Specific examples of such couplers are mentioned in U.S. Pat. Nos. 2,407,210, 2,875,057, and 3,265,506, among others. The two-equivalent yellow coupler includes, among others, the yellow couplers of the oxygen atom coupling off type as set forth in U.S. Pat. Nos. 3,408,194, 3,447,928, 3,993,501 and 4,022,620 and the yellow couplers of the nitrogen atom coupling off type such as those described in Japanese Patent Publication No. 10739/83, U.S. Pat. Nos. 4,401,752 and 4,326,024, *Research Disclosure,* RD No. 18053 (April 1979), British Pat. No. 1,425,020, West German Patent Application (OLS) Nos. 2,219,917, 2,261,361, 2,329,587 and 2,433,812, and so on. Alpha-pivaloylacetanilide type couplers are satisfactory in the fastness, particularly the light fastness, of the produced color, while α-benzoylacetanilide type couplers yield high color densities.

The magenta couplers which are compatible with the present invention may, for example, be oil protect type indazolone or cyanoacetyl couplers, preferably 5-pyrazolone and pyrazoloazole (e.g., pyrazolotriazole) couplers. Among 5-pyrazolone type couplers, a coupler having an arylamino or acylamino group as a substituent at the 3-position is preferred in terms of the hue and density of color developed, and typical examples of such compound are described in U.S. Pat. Nos. 2,311,082, 2,343,703, 2,600,788, 2,908,573, 3,062,653, 3,152,896, and 3,936,015, among others. The coupling off group of a two-equivalent 5-pyrazolone type coupler is preferably a nitrogen atom coupling off group as set forth in U.S. Pat. No. 4,310,619, or an arylthio group as described in U.S. Pat. No. 4,351,897. With 5-pyrazolone type couplers having ballasting groups as described in European Pat. No. 73,636, high color density can be obtained.

Examples of said pyrazoloazole type couplers include the pyrazolobenzimidazole compounds described in U.S. Pat. No. 3,369,879 and preferably the pyrazolo[5,1-C][1,2,4]triazoles described in U.S. Pat. No. 3,725,067, the pyrazolotetrazoles mentioned in *Research Disclosure,* RD No. 24220 (June 1984), and the pyrazolopyrazoles mentioned in *Research Disclosure,* RD No. 24230 (June 1984). In view of the scarcity of yellow side absorption of the developed dye and in terms of light fastness, the imidazo[1,2-b]pyrazoles described in European Pat. No. 119,741 are preferred, and the pyrazole[1,5-b][1,2,4]triazoles described in European Pat. No. 119,860 are particularly preferable.

The cyan couplers which are compatible with the present invention include oil protect type naphthol and phenol couplers, and specific examples of such cyan couplers include the naphthol type couplers described in U.S. Pat. No. 2,474,293 and, preferably, two-equivalent naphthol couplers of oxygen atom coupling off type such as those described in U.S. Pat. Nos. 4,052,212, 4,146,396, 4,228,233 and 4,296,200. Typical examples of said phenol type couplers are described in U.S. Pat. Nos. 2,369,929, 2,801,171, 2,772,162 and 2,895,826, among others. Humidity-resistant and heat-resistant cyan couplers can be used to advantage in accordance with the present invention. Typical examples of such cyan couplers include phenol type couplers having an alkyl group containing two or more carbon atoms at the meta-position of the phenol nucleus described in U.S. Pat. No. 3,772,002, the 2,5-diacylamino-substituted phenol couplers described in U.S. Pat. Nos. 2,772,162, 3,758,308, 4,126,396, 4,334,011 and 4,327,173, West German Patent Application (OLS) No. 3,329,729 and U.S. Pat. No. 4,500,635, among others, and the phenol type couplers having a phenylureido group at the 2-position and an acylamino group at the 5-position described in U.S. Pat. Nos. 3,446,622, 4,333,999, 4,451,559 and 4,427,767, among others.

In order to correct for the unwanted absorptions in the short wavelength region due to the dyes derived from magenta and cyan couplers, it is also often desirable to use colored couplers in the color photosensitive materials for picture-taking use. Typical examples of such colored couplers are the yellow-colored magenta couplers described in U.S. Pat. No. 4,163,670 and Japanese Patent Publication No. 39413/82 and the magenta-colored cyan couplers described in U.S. Pat. Nos. 4,004,929 and 4,138,258, and British Pat. No. 1,146,368.

Improved granularity can be achieved by the concomitant use of couplers ensuring a suitable diffusibility of the developed dye. Specific examples of such couplers are described in U.S. Pat. No. 4,366,237 and British Pat. No. 2,125,570 (examples of magenta couplers) and in European Pat. No. 96,570 and West German Patent Application (OLS) No. 3,234,533 (examples of pertinent yellow, magenta, and cyan couplers).

The color-forming couplers and the above-described special couplers may each be a dimer, oligomer, or polymer. Examples of such polymeric dye-forming couplers are mentioned in U.S. Pat. Nos. 3,451,820 and 4,080,211. British Pat. No. 2,102,173 and U.S. Pat. No. 4,367,282 describe examples of polymerized magenta couplers.

These couplers may be either four-equivalent and two-equivalent with respect to silver ion. They may be colored couplers for color correction or couplers adapted to release a development inhibitor on development (DIR couplers).

In addition to the DIR couplers, colorless DIR coupling compounds which give colorless coupling products and release development inhibitors may also be incorporated in the photosensitive material. Aside from the DIR couplers, other compounds that release development restrainers may also be present in the photosensitive material.

In order to meet the specific requirements of each photosensitive material, the above-mentioned various couplers may be incorporated in a combination of two or more kinds in the same photographic layer or the same compound may be incorporated in two or more different layers.

Incorporation of the couplers according to the present invention and the aforementioned compatible couplers in the silver halide emulsion layers can be effected by known procedures, such as the method described in U.S. Pat. No. 2,322,027. By way of illustration, the compound to be incorporated is first dissolved in a solvent such as phthalic acid alkyl esters (e.g., dibutyl phthalate, dioctyl phthalate, etc.), phosphoric acid esters (e.g., diphenyl phosphate, triphenyl phosphate, tricresyl phosphate, dioctyl butyl phosphate, etc.), citric acid esters (e.g., tributyl acetylcitrate, etc.), benzoic acid esters (e.g., octyl benzoate, etc.), alkylamides (e.g., diethyllaurylamide, etc.), fatty acid esters (e.g., dibutoxyethyl succinate, diethyl azelate, etc.), trimesic acid esters (e.g., tributyl trimesinate, etc.), etc., an organic solvent having a boiling point in the range of about 30° C. to 150° C., e.g., a lower alkyl acetate such as ethyl acetate, butyl acetate, etc., ethyl propionate, sec-butyl alcohol, methyl isobutyl ketone, β-ethoxyethyl acetate, methylcellosolve, and so on. The solution is evenly dispersed in a hydrophilic colloid. The above high-boiling and low-boiling organic solvents may be used as a mixture.

It is also possible to employ the dispersing method involving the use of a polymer as described in Japanese Patent Publication No. 39853/76 and Japanese Patent Application (OPI) No. 59943/76.

When the coupler has an acid group such as a carboxy or sulfo group, it is added in the form of an alkaline aqueous solution to the hydrophilic colloid.

As the binder or protective colloid that can be used in the emulsion layers and intermediate layers of the light-sensitive material according to the present invention, gelatin is advantageous, but other hydrophilic colloids can also be used alone or in combination with gelatin.

The gelatin used in the practice of the present invention may be either lime-treated gelatin of acid-treated gelatin. A detailed discussion on methods for preparing gelatins can be found in Arthur Veis, *The Macromolecular Chemistry of Gelatin,* Academic Press, 1964.

As to the silver halide for use in the preparation of photographic emulsion layers of the color photographic photosensitive material according to the present invention, any of silver bromide, silver iodobromide, silver iodochlorobromide, silver chlorobromide, and silver chloride can be used.

There is no particular limitation on the average grain size of silver halide in the photographic emulsion, but the average grain size is preferably not greater than 3 μm (the average grain size is such that in the case of spherical or psuedo-spherical grains, the diameter of the grain is taken as the grain size, and in the case of cubic grains, the length of the edge of the cube is regarded as the grain size, and the average grain size is calculated from the projected area).

The grain size distribution may be narrow or broad.

The geometry of silver halide grains in the photographic emulsions may be cubic, octahedral, or of any other regular crystal shape or have such irregular crystal shapes as spheres, tablets, etc. or a composite of such shapes. The grains may be present as a mixture of grains having various crystal shapes.

It is possible to use an emulsion in which ultraflat tabular silver halide grains whose diameters are more than 5 times their thicknesses account for more than 50 percent of the total projected area.

The silver halide grain may have different phases in the core region and the surface region from each other. It may be a grain wherein the latent image is predominantly formed in the surface region or in the core region.

The photographic emulsion employed in accordance with the present invention can be prepared by the methods described, for example, in P. Glafkides, *Chimie et Physique Photographique* (Paul Montel, 1966); and V. L. Zelikman et al, *Making and Coating Photographic Emulsion* (The Focal Press, 1964). Thus, any of the acid method, neutral method, ammonia method, etc., can be utilized, and as the method comprising reacting a soluble silver salt with a soluble halogen salt, any of a single-jet method, double-jet method, or a combination thereof may be employed.

The method in which grains are formed in the presence of an excess of silver ion (the so-called reverse-jet method) may also be employed. As a mode of double-jet addition, one may employ the controlled double-jet method, wherein the pAg in the liquid phase wherein silver halide is formed is kept constant.

This particular method yields a silver halide emulsion which is regular in crystal shape and nearly uniform in grain size.

It is also possible to admix two or more independently prepared silver halide emulsions.

In the course of formation or physical ripening of silver halide grains, such compounds as cadmium salts, zinc salts, lead salts, thallium salts, iridium salts and complex salts thereof, rhodium salts and complex salts thereof, iron salts and complex salts thereof, etc. may be allowed to be present concomitantly.

The silver halide emulsions are usually chemically sensitized. For chemical sensitization, the methods described in H. Frieser (ed.), *Die Grundlagender Photographischen Prozesse mit Silber Halogeniden,* Akademische Verlagsgesellschaft, 1968, pp. 675–734, for instance, can be employed.

Thus, the sulfur sensitizing method involving the use of a sulfur-containing compound capable of reacting with activated gelatin and silver (for example, thiosulfates, thiourea compounds, mercapto compounds, rhodanines, etc.), reduction sensitization utilizing reducing agents (such as stannous salts, amines, hydrazine, derivatives, formamidine-sulfinic acid, silane compounds, etc.), noble metal sensitization using a noble metal (for example, complex salts of gold, complex salts of metals of elements of Group VIII of Periodic Table of the Elements, such as Pt, Ir, Pd, etc.), and other sensitization methods may be used, singly or in combination.

For the purpose of preventing fogging during the manufacture and storage of photosensitive materials or during photographic processing or/and for stabilizing the photographic performance qualities, a variety of compounds may be incorporated. Thus, there may be incorporated many compounds known as antifoggants or stabilizers, for example, various azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly, 1-phenyl-5-mercaptotetrazole), etc.; mercaptopyrimidines; mercaptotriazines; thioketo compounds such as oxazolinethiones; azaindenes such as triazaindenes, tetraazaindenes (particularly, 4-hydroxy-substituted(1,3,3a,7)tetraazaindenes), pentaazaindenes, etc.; benzenethiosulfonic acid; benzenesulfinic acid; benzenesulfonamide; and so on.

The photographic emulsion layers or other hydrophilic colloid layers in the light-sensitive material according to the present invention may contain various surfactants added for varied purposes, e.g., as coating auxiliaries or antistatic agents, or for surface lubrication, emulsification and dispersion, prevention of adhesion, improvement of photographic characteristics (for example, development acceleration, tone hardening, sensitization, etc.) and so on.

For increased sensitivity, increased contrast or development acceleration, the silver halide emulsions in the color photographic light-sensitive material according to the present invention may contain, among others, polyalkylene oxides and their ethers, esters, amines and other derivatives, thioether compounds, thiomorpholine compounds, quaternary ammonium salts, urethane derivatives, urea derivatives, imidazole derivatives, 3-pyrazolidones and so on.

For improved dimensional stability and other purposes, the color photographic light-sensitive material according to the present invention may contain dispersions of synthetic polymers either insoluble or only sparingly soluble in water in its photographic emulsion layers or other hydrophilic colloid layers. Such polymers may be homopolymers or copolymers of monomers such as alkyl acrylates, alkyl methacrylates, alkoxyalkyl acrylates, alkoxyalkyl methacrylates, glycidyl acrylate, glycidyl methacrylate, acrylamide, methacrylamide, vinyl esters (e.g., vinyl acetate), acrylonitrile, olefins, styrene, and so on or copolymers of said various monomers with other comonomers such as acrylic acid, methacrylic acid, $\alpha,\beta$-unsaturated dicarboxylic acids, hydroxyalkyl acrylates, hydroxyalkyl methacrylates, sulfoalkyl acrylates, sulfoalkyl methacrylates, styrenesulfonic acid and so on.

The photographic emulsions used in the present invention may be spectrally sensitized with methine dyes and the like. The dyes used for this purpose include cyanine dyes, merocyanine dyes, complex cyanine dyes, complex merocynaine dyes, holopolar cyanine dyes, hemicyanine dyes, styryl dyes, and hemioxonol dyes. Particularly useful dyes are cyanine dyes, merocyanine dyes and complex merocyanine dyes. For these dyes, any of the basic heterocyclic nuclei commonly used in cyanine dyes can be employed. Examples thereof include a pyrroline, oxazoline, thiazoline, pyrrole, oxazole, thiazole, selenazole, imidazole, tetrazole, and pyridine nucleus and other heterocyclic nuclei; nuclei formed by fusion of alicyclic nuclei to said heterocyclic nuclei; and nuclei formed by fusion of aromatic rings to such nuclei; for example, indolenine, benzindolenine, indole, benzoxazole, naphthoxazole, benzothiazole, naphthothiazole, benzoselenazole, benzimidazole, quinoline and other ring structures. These nuclei may have substituents on carbon atoms.

With regard to merocyanine dyes or complex merocyanine dyes, as nuclei having ketomethylene structure, 5-to 6-membered heterocyclic nuclei such as a pyrazolin-5-one, thiohydantoin, 2-thiooxazolidine-2,4-dione, thiazolidine-2,4-dione, rhodanine, thiobarbituric acid nucleus, and so on may be employed.

These sensitizing dyes may be used either alone or in combination and a combination of sensitizing dyes is frequently used for supersensitizing purposes.

Along with sensitizing dyes, supersensitizing substances which per se have no spectral sensitizing activity or do not substantially absorb visible light, may also be incorporated in the emulsion. For example, aminostyryl compounds substituted by nitrogen-containing heterocyclic groups (for example, the compounds described in U.S. Pat. Nos. 2,933,390 and 3,635,721), aromatic organic acid-formaldehyde condensates (for example, the compounds described in U.S. Pat. No. 3,743,510), cadmium salts, azaindene compounds and so forth may be incorporated.

The photographic light-sensitive materials according to the present invention may contain an organic or inorganic hardener in the photographic emulsion layers and other hydrophilic colloid layers. For example, chromium salts (chromium alum, chromium acetate, etc.), aldehydes (formaldehyde, glyoxal, glutaraldehyde, etc.), N-methylol compounds (dimethylolurea, methyloldimethylhydantoin, etc.) dioxane derivatives (2,3-dihydroxydioxane, etc.), active vinyl compounds (1,3,5-triacryloyl-hexahydro-s-triazine, 1,3-vinylsulfonyl-2-propanol, etc.), active halogen compounds (2,4-dichloro-6-hydroxy-s-triazine, etc.), mucohalogenic acids (mucochloric acid, mucophenoxychloric acid, etc.) and so on may be used alone or in combination.

In the light-sensitive material according to the present invention, when dyes, ultraviolet ray absorbing agents and the like are included in the hydrophilic colloid layers, they may have been mordanted by cationic polymers.

The photosensitive material according to the present invention can contain anti-color fogging agents such as hydroquinone derivatives, aminophenol derivatives, gallic acid derivatives, ascorbic acid derivatives, and so on.

In the photographic material prepared in accordance with the present invention, there may be incorporated ultraviolet ray absorbing agents in its hydrophilic colloid layers. For example, there may be utilized aryl-substituted benzotriazole compounds (for example, the compounds described in U.S. Pat. No. 3,533,794), 4-thiazolidone compounds (for example, the compounds described in U.S. Pat. Nos. 3,314,794 and 3,352,681), benzophenone compounds (for example, those described in Japanese Patent Application (OPI) No. 2784/71, cinnamic acid ester compounds (for example, the compounds described in U.S. Pat. Nos. 3,705,805 and 3,707,375), butadiene compounds (for example, the compounds described in U.S. Pat. No. 4,045,229) and benzoxazole compounds (for example, the compounds described in U.S. Pat. No. 3,700,455). The ultraviolet-absorbing couplers (for example, cyan-forming couplers in the $\alpha$-naphthol series) and ultraviolet ray absorbing polymers. These ultraviolet absorbers may have been mordant in specific layers.

The photosensitive material according to the present invention may contain, in its hydrophilic colloid layers, certain water-soluble dyes as filter dyes or for prevention of irradiation and other purposes. Among such dyes are oxonol dyes, hemioxonol dyes, styryl dyes, merocyanine dyes, cyanine dyes, and azo dyes. Particularly useful are oxonol dyes, hemioxonol dyes, and merocyanine dyes.

In practicing the present invention, the undermentioned known fading inhibitors can be employed in conjunction and the color image stabilizers used in the practice of the present invention may be used alone or in combination. The known fading inhibitors include hydroquinone derivatives, gallic acid derivatives, p-alkoxyphenols, p-oxyphenol derivatives, bisphenols, and so on.

In the photographic processing of the silver halide photographic light-sensitive material according to the present invention, any of the known methods inclusive of wet processing, thermal development, and so on can be utilized.

When wet processing is carried out, known processing solutions can be utilized. The processing temperature is generally selected from the range of 18° C. to 50° C., although a temperature either below 18° C. or over 50° C. may be employed. According to the intended application, either black-and-white development for production of a silver image or color development for production of a color image can be applied.

The developer solution for black-and-white photographic processing may contain the known developing agents. As such developing agent, dihydroxybenzenes (for example, hydroquinone), 3-pyrazolidones (for example, 1-phenyl-3-pyrazolidone), aminophenols (for example, N-methyl-p-aminophenol), 1-phenyl-3-pyrazolines, ascorbic acid, and the heterocyclic compounds such as the fused ring system consisting of a 1,2,3,4-tetrahydroquinoline ring and an indolene ring described in U.S. Pat. No. 4,067,872, among others, can be used, singly or in combination. The developer solution generally may contain known preservatives, alkaline agents, pH buffers, antifoggants, etc., and, further, color toners, development accelerators, surface active agents, antifoaming agents, water softeners, hardeners, thioxotropic agents, and so on.

As the fixing solution, one having the conventional composition can be employed. The fixing agent may be either a thiosulfate or a thiocyanate. Also, an organic sulfur compound known to be an effective fixing agent may be employed. The fixing solution may contain a water-soluble aluminum salt as a hardener.

For the formation of a color image, conventional methods can be utilized. For example, one may utilize the negative-positive process (see, for example, *Journal of the Society of Motion Picture and Television Engineers*, Vol. 61, 1953, pp. 667–701), the color reversal process which comprises forming a negative silver image with a black-and-white developer solution, performing at least one uniform light reexposure or a suitable fogging treatment, and then performing color development to obtain a positive color image. A silver dye bleach process may be used, in which a dye-containing photographic emulsion layer is imagewise exposed and then developed to produce a silver image, and the dye is then bleached by utilizing the silver as a bleaching catalyst.

The color developer is generally an alkaline aqueous solution containing the color developing agent. As the color developing agent, one may employ the conventional primary aromatic amine developers such as phenylenediamines (for example, 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline, and so on.

Aside from the above compounds, compounds described in F. A. Mason, Photographic Processing Chemistry (The Focal Press, 1966), pp. 226–229, U.S. Pat. Nos. 2,193,015 and 2,592,364, and Japanese Patent Application (OPI) No. 64933/72, for instance, may also be employed.

The color developer may include pH buffers such as alkali metal sulfites, carbonates, borates, and phosphates, and development inhibitors or antifoggants such as bromides, iodides or organic antifoggants. If desired, various water softening agents, preservatives such as hydroxylamine, etc., organic solvents such as benzyl alcohol, diethylene glycol, etc., development accelerators such as polyethylene glycol, quaternary ammonium salts, amines, etc., dye forming couplers, competing couplers, fogging agents such as sodium borohydride, development auxiliaries such as 1-phenyl-3-pyrazolidone, etc., thioxotropic agents, polycarboxylic acid type chelating agents, oxidation preventing agents, and so on may also be added.

The photographic emulsion layers following color development are generally bleached. This bleaching treatment can be conducted simultaneously with fixation or independently of fixation. The bleaching agents include polyvalent metal compounds such as iron (III), cobalt (III), chromium (VI) and copper (II) compounds, peracids, quinones, nitroso compounds, and so on.

For example, ferricyanides, dichromates, organic iron (III) or cobalt (III) complex salts, aminopolycarboxylic acids such as ethylenediaminetetraacetic acid, nitrilotriacetic acid, 1,3-diamino-2-propanoltetraacetic acid, etc., complex salts of organic acids such as citric acid, tartaric acid, maleic acid, etc., persulfates, permanganates, nitrosophenol, and so on may be employed. Among these compounds, potassium ferricyanide, sodium Fe (III) ethylenediaminetetraacetate, and ammonium Fe (III) ethylenediaminetetraacetate are particularly useful. The Fe (III) ethylenediaminetetraacetate complex salt is useful not only in an independent bleach solution but also in a bleach-fix system.

As the fixing solution, one having the usual composition can be employed. The fixing agent may be either a thiosulfate or a thiocyanate. Also, an organic sulfur compound known to be an effective fixing agent may be employed. The fixing solution may contain a water-soluble aluminum salt as a hardener.

While the fixation process or the bleach-fix process is generally followed by aqueous washing, stabilization and other treatments, an expedient procedure involving a washing step only, or, conversely, one involving a stabilization step without any substantial washing (see Japanese Patent Application (OPI) No. 8543/82) may also be employed.

In the water to be used in the washing process, conventional additives may be incorporated. For example, chelating compounds such as inorganic phosphates, aminopolycarboxylic acids, organic phosphates, etc., bactericides and antifungal agents for inhibiting growth of various bacteria algae, hardeners such as magnesium salts, aluminum salts, etc., and surfactants adapted to prevent drying load and uneveness may be employed. The compounds described in L. E. West, "Water Quality Criteria", *Photographic Science and Engineering*, Vol. 9, No. 6, pp. 344–359 (1965), for instance, may likewise be employed.

The washing may be carried out using two or more vessels as necessary or, to effect savings in water, a multi-stage (e.g., 2- to 9-stage) countercurrent washing system may be employed.

As the stabilizing solution for use in the stabilization process, a solution adapted to stabilize the color image is employed. For example, a solution containing a buffering solution having a pH of 3 to 6 or an aldehyde (e.g., formaldehyde) may be utilized. In the stabilizing solution, a fluorescent whitener, chelating agent, bactericide, antifungal agent, hardener, surfactant, and so on may be incorporated, if desired.

The stabilization procedure may be carried out using two or more vessels, or, to effect savings in the stabilizing solution and omit an independent washing step, a multi-stage (e.g., 2- to 9-stage) countercurrent stabilization system may be utilized.

The following examples are intended to illustrate the present invention in further detail, but should not be construed as limiting the scope of the invention.

EXAMPLE 1

On a polyethylene terephthalate film support, a multilayer color photosensitive material was formed, consisting of layers of the following compositions.

| | |
|---|---|
| **First layer: an antihalation layer** | |
| A gelatin layer containing black colloidal silver | |
| **Second layer: an intermediate layer** | |
| A gelatin layer containing an emulsified dispersion of 2,5-di-t-octylhydroquinone | |
| **Third layer: a first red-sensitive emulsion layer** | |
| Silver iodobromide emulsion (silver iodide 5 mole %) | Silver coverage 1.6 g/m$^2$ |
| Sensitizing dye I | $4.5 \times 10^{-4}$ moles/mole Ag |
| Sensitizing dye II | $1.5 \times 10^{-4}$ moles/mole Ag |
| Coupler EX-1 | 0.03 mole/mole Ag |
| Coupler EX-3 | 0.003 mole/mole Ag |
| **Fourth layer: a second red-sensitive emulsion layer** | |
| Silver iodobromide emulsion (silver iodide 10 mole %) | Silver coverage 1.4 g/m$^2$ |
| Sensitizing dye I | $3 \times 10^{-4}$ moles/mole Ag |
| Sensitizing dye II | $1 \times 10^{-4}$ moles/mole Ag |
| Coupler EX-1 | 0.002 mole/mole Ag |
| Coupler EX-2 | 0.02 mole/mole Ag |
| Coupler EX-3 | 0.0016 mole/mole Ag |
| **Fifth layer: an intermediate layer** | |
| Same as the second layer. | |
| **Sixth layer: a first green-sensitive emulsion layer** | |
| Silver iodobromide emulsion (silver iodide 6 mole %) | Silver coverage 1.8 g/m$^2$ |
| Sensitizing dye III | $5 \times 10^{-4}$ moles/mole Ag |
| Sensitizing dye IV | $2 \times 10^{-4}$ moles/mole Ag |
| Coupler EX-4 | 0.05 mole/mole Ag |
| Coupler EX-5 | 0.008 mole/mole Ag |
| Coupler EX-9 | 0.003 mole/mole Ag |
| **Seventh layer: a second green-sensitive emulsion layer** | |
| Silver iodobromide emulsion (silver iodide 8 mole %) | Silver coverage 1.3 g/m$^2$ |

-continued

| | |
|---|---|
| Sensitizing dye III | $3 \times 10^{-4}$ moles/mole Ag |
| Sensitizing dye IV | $1.2 \times 10^{-4}$ moles/mole Ag |
| Coupler EX-7 | 0.017 mole/mole Ag |
| Coupler EX-6 | 0.003 mole/mole Ag |
| **Eighth layer: a yellow filter layer** | |
| A gelatin layer containing yellow colloidal silver and a 2,5-di-t-octylhydroquinone emulsion in an aqueous solution of gelatin | |
| **Ninth layer: a first blue-sensitive emulsion layer** | |
| Silver iodobromide emulsion (silver iodide 6 mole %) | Silver coverage 0.7 g/m$^2$ |
| Coupler EX-8 | 0.25 mole/mole Ag |
| Coupler EX-9 | 0.015 mole/mole Ag |
| **Tenth layer: a second blue-sensitive emulsion layer** | |
| Silver iodobromide emulsion (silver iodide 6 mole %) | Silver coverage 0.6 g/m$^2$ |
| Coupler EX-8 | 0.06 mole/mole Ag |
| **Eleventh layer: a first protective layer** | |
| A gelatin layer containing: | |
| Silver iodobromide emulsion (silver iodide 1 mole %, average grain size 0.07 μm) | Silver coverage 0.5 g/m$^2$ |
| An emulsified dispersion of ultraviolet absorber UV-1 | |
| **Twelfth layer: a second protective layer** | |
| A gelatin layer containing: | |
| Polymethyl methacrylate grains (diameter about 1.5 μm) | |

In addition to the above composition, a gelatin hardener H-1 and a surfactant were incorporated in each layer. The sample prepared above was designated Sample 101. Preparation of Samples 102 to 111

These samples were prepared in the same manner as Sample 101 except that the Coupler Ex-9 in the low-sensitivity green sensitive emulsion layer of Sample 101 was replaced with other compounds as shown in Table 1.

The Samples 101 to 111 were respectively exposed to white light using a sensitometric wedge and processed by the procedures described hereinafter. The resulting developed images were substantially comparable both in sensitivity and in gradation. The green-sensitive layers of these samples were evaluated as to sharpness in terms of MTF value in the routine manner as described in T. H. James Ed., *The Theory of the Photographic Process*, 4th Ed., Macmillan Publishing Co., Inc. (1977), p. 604.

The structural formulae of the compounds used are shown below.

Coupler

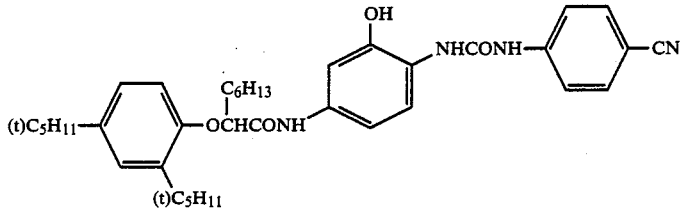

EX-1

-continued
EX-2
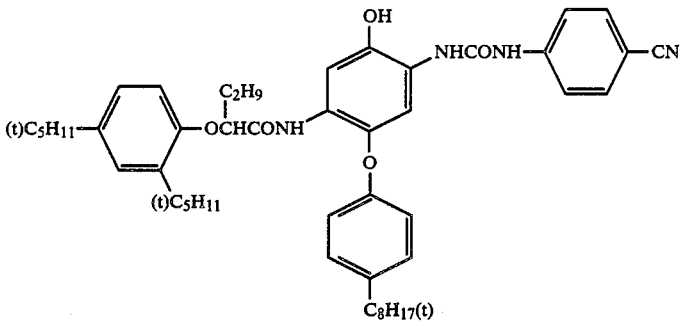
EX-3
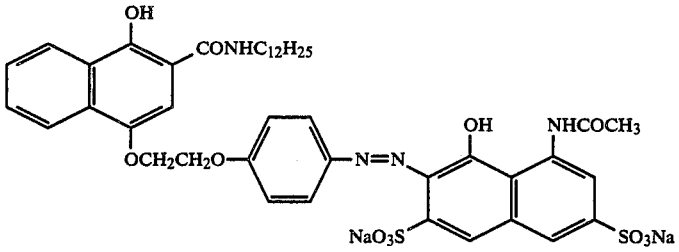
EX-4
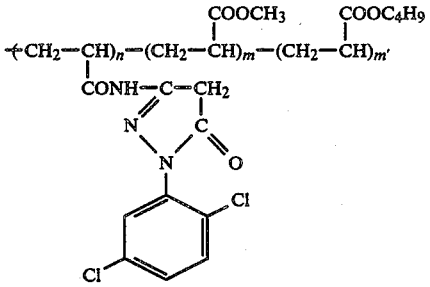
n/m + m' = 1 (Weight ratio)
m/m' = 1 (Weight ratio)
Molecular weight ca. 40,000
EX-5
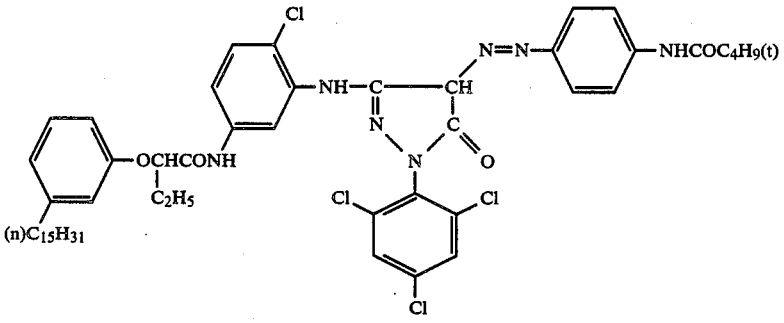
EX-6
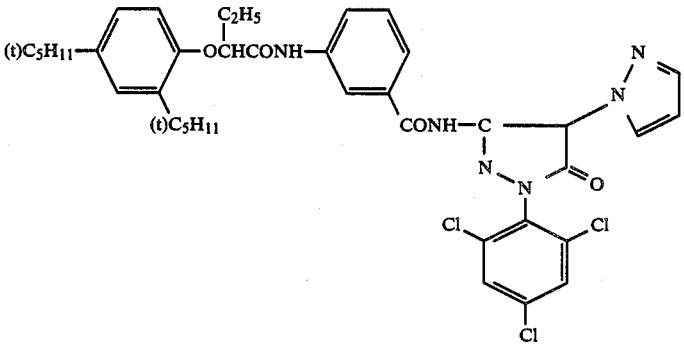

-continued
EX-7
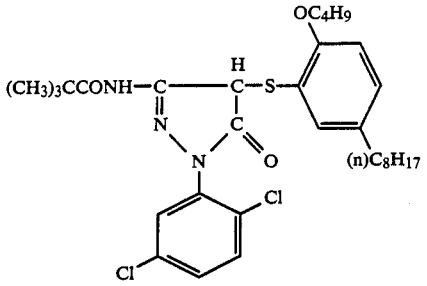
where (t)$C_8H_{17}$ indicates the group
$(CH_3)_3CCH_2C(CH_3)_2$—
EX-8
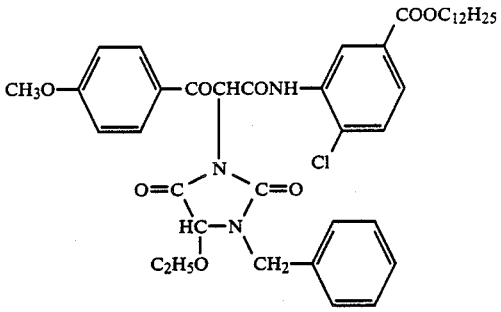
(Conventional DIR coupler)
EX-9
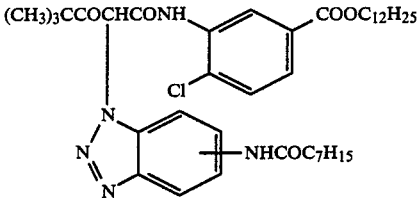
(Compound described in U.S. Pat. No. 4,248,962)
EX-10
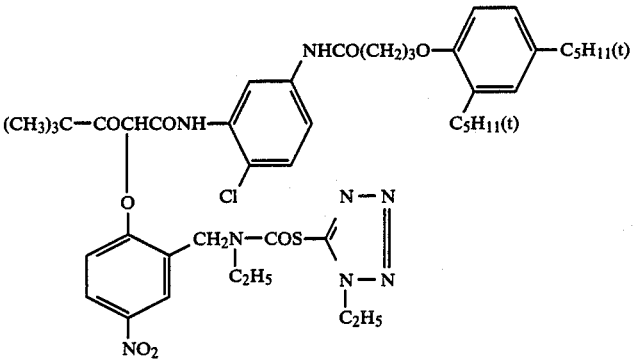
(Compound described in U.S. Pat. No. 3,930,863)
EX-11
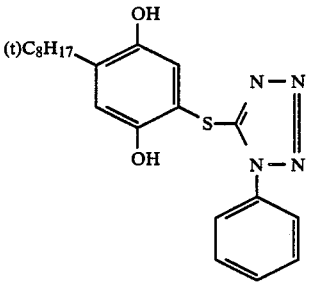
(Compound described in U.S. Pat. No. 4,144,071)
EX-12
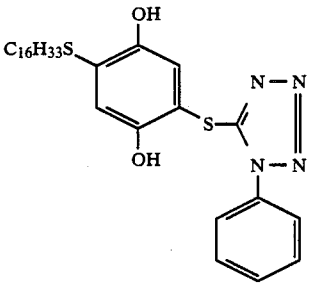
(Compound described in U.S. Pat. No. 4,438,193)
EX-13

-continued

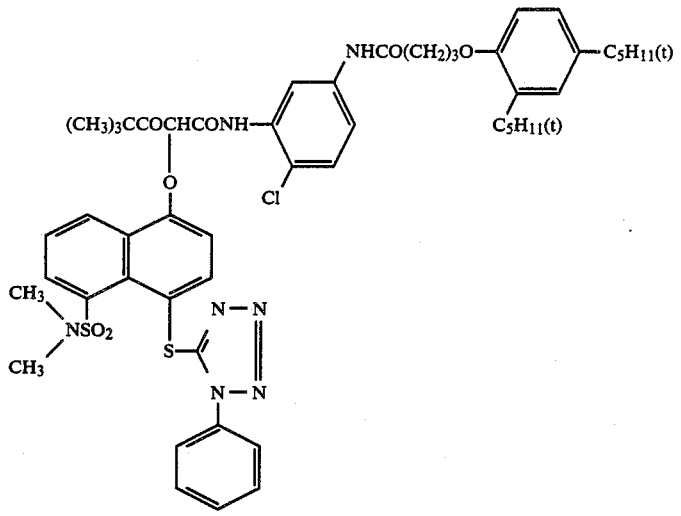

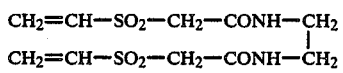

H-1

UV-1

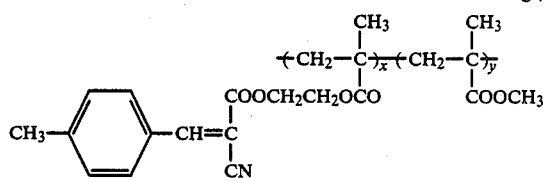

x/y = 7/3 (Weight ratio)

Sensitizing dye I

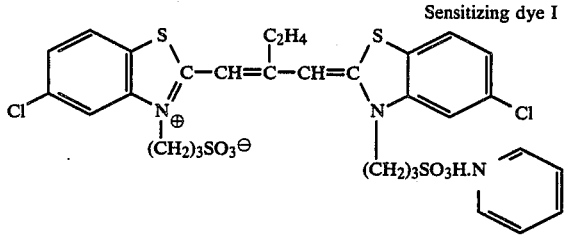

Sensitizing dye II

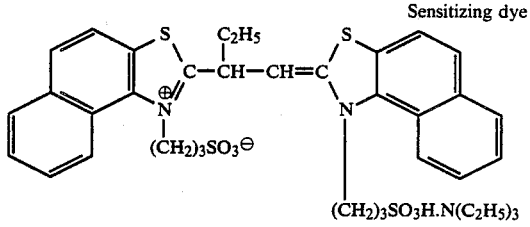

Sensitizing dye III

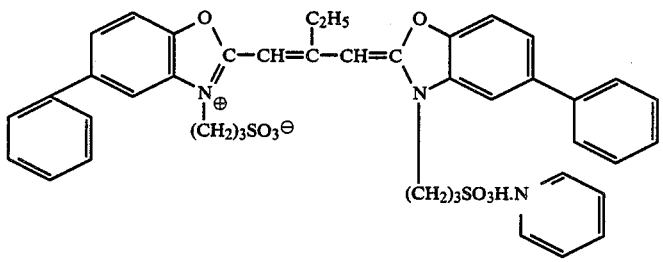

Sensitizing dye IV

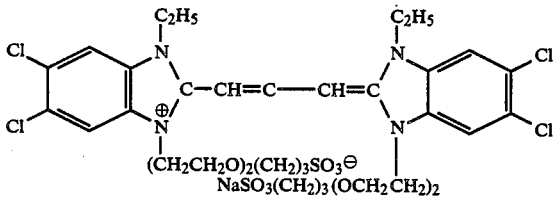

In the above procedure, the development and processing were conducted at 38° C. in accordance with the following schedule.

| | |
|---|---|
| Color development | 3 min. 15 sec. |
| Bleaching | 6 min. 30 sec. |
| Washing | 2 min. 10 sec. |

-continued

| | |
|---|---|
| Fixation | 4 min. 20 sec. |
| Washing | 3 min. 15 sec. |
| Stabilizing | 1 min. 05 sec. |

The processing compositions used in the respective steps were as follows.

| | | |
|---|---|---|
| **Color developer solution** | | |
| Diethylenetriaminepentaacetic acid | | 1.0 g |
| 1-Hydroxyethylidene-1,1-diphosphonic acid | | 2.0 g |
| Sodium sulfite | | 4.0 g |
| Potassium carbonate | | 30.0 g |
| Potassium bromide | | 1.4 g |
| Potassium iodide | | 1.3 mg |
| Hydroxylamine sulfate | | 2.4 g |
| 4-(N—Ethyl-N—β-hydroxyethylamino)-2-methylaniline sulfate | | 4.5 g |
| Water to make | | 1.0 l |
| | pH | 10.0 |
| **Bleaching solution** | | |
| Ferric ammonium ethylenediaminetetraacetate | | 100.0 g |
| Disodium ethylenediaminetetraacetate | | 10.0 g |
| Ammonium bromide | | 150.0 g |
| Ammonium nitrate | | 10.0 g |
| Water to make | | 1.0 l |
| | pH | 6.0 |
| **Fixing solution** | | |
| Disodium ethylenediaminetetraacetate | | 1.0 g |
| Sodium sulfite | | 4.0 g |
| Ammonium thiosulfate (70% aqueous solution) | | 175.0 ml |
| Sodium hydrogen sulfite | | 4.6 g |
| Water to make | | 1.0 l |
| | pH | 6.6 |
| **Stabilizing solution** | | |
| Formalin (40 wt % formaldehyde) | | 2.0 ml |
| Polyoxyethylene-p-monononylphenylether (average degree of polymerization is ca. 10) | | 0.3 g |
| Water to make | | 1.0 l |

Using each sample, the MTF value of the green-sensitive layer was measured at 4 and 40 cycles/mm. The results are shown in Table 1.

TABLE 1

| Sample | Compound in the first green-sensitive layer* | Level of addition** | MTF 4 cycles/mm | MTF 40 cycles/mm |
|---|---|---|---|---|
| 101 (Control Example) | EX-9 | 1.0 | 1.08 | 0.45 |
| 102 (Control Example) | EX-10 | 2.0 | 1.10 | 0.47 |
| 103 (Control Example) | EX-11 | 3.0 | 1.08 | 0.46 |
| 104 (Control Example) | EX-12 | 1.0 | 1.10 | 0.47 |
| 105 (Control Example) | EX-13 | 4.0 | 1.10 | 0.47 |
| 106 (The Invention) | (1) | 3.0 | 1.18 | 0.52 |
| 107 (The Invention) | (2) | 3.0 | 1.19 | 0.53 |
| 108 (The Invention) | (3) | 1.5 | 1.16 | 0.51 |
| 109 (The Invention) | (11) | 3.0 | 1.16 | 0.52 |
| 110 (The Invention) | (21) | 2.0 | 1.17 | 0.52 |
| 111 (The Invention) | (26) | 3.0 | 1.17 | 0.52 |

*The compound added in lieu of the coupler EX-9 in the first green-sensitve emulsion layer.
**The number of moles with the level of addition of EX-9 being taken as unity.

It is clear from the data in Table 1 that the compounds according to the present invention produce marked improvements in sharpness as compared with the conventional compounds.

EXAMPLE 2

The mixing of an aqueous solution of silver nitrate and an aqueous solution of silver halide was conducted in the presence of $5\times10^{-6}$ mole of rhodium ammonium chloride per mole of silver in the conventional manner to produce silver chlorobromide grains. The resulting monodispersed silver chlorobromide emulsion (mean grain size 0.30 μm, silver bromide content 30 mole%) was subjected to the routine sedimentation washing procedure and to chemical sensitization by the addition of sodium thiosulfate and potassium chloroaurate.

To the above emulsion were added 4-hydroxy-6-methyl-1,3,3a,7-tetraazaindene, dispersed polyethyl acrylate, polyethylene glycol (average molecular weight 1,000), 1,3-bis-vinylsulfonyl-2-propanol, sensitizing dye (a) and nucleating agent (b), followed by addition of the compound of general formula (I) according to the present invention. The emulsion was coated on a polyethylene terephthalate film at a silver coverage of 3.5 g/m$^2$ and a gelatin coverage of 2.0 g/m$^2$. Moreover, a gelatin-based aqueous solution containing coating auxiliaries such as a surface active agent, thioxotropic agent, etc., is coated simultaneously on the thus coated emulsion layer at a gelatin coverage of 1.1 g/m$^2$ to prepare samples (201 to 206). Further, samples (207 to 210) were prepared using the same formula as above except that the control compound (c) or (e) was used in lieu of the compound of formula (I).

Each of the above samples were exposed using a sensitometric wedge and further exposed with the gray scanner negative contact screen No. 2, 150 L of Dainippon Screen Co., Ltd. The exposed sample was then developed with the developer solution described hereinafter at 38° C. for 30 seconds, fixed, washed and dried.

The structural formulae of the compounds used are shown below.

Sensitizing dye (a)

-continued

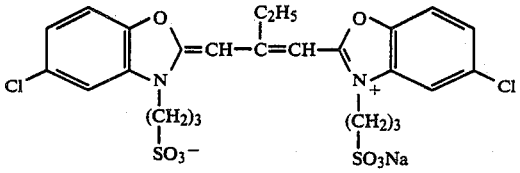

Nucleating agent (b)

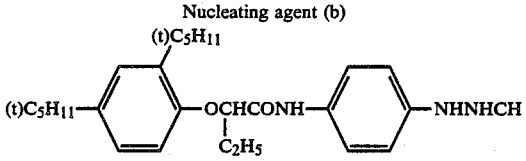

Comparative compound (c)
(Compound described in U.S. Pat. No. 4,144,071)

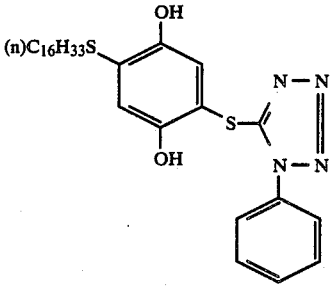

Comparative compound (d)
(Compound described in Research Disclosure, RD No. 18104)

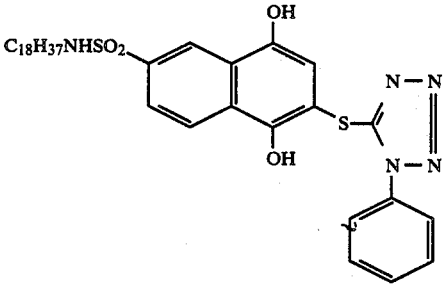

Comparative compound (e)
(Compound described in U.S. Pat. No. 3,379,529)

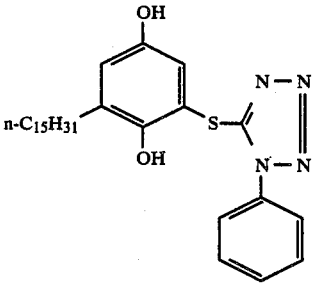

Comparative compound (f)

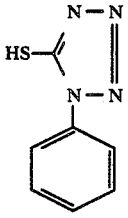

| Composition of developer solution | |
|---|---|
| Hydroquinone | 40.0 g |
| 4,4-Dimethyl-1-phenyl-3-pyrazolidone | 0.4 g |
| Anhydrous sodium sulfite | 75 g |
| Sodium hydrogen carbonate | 7.0 g |
| Disodium ethylenediaminetetraacetate | 1.0 g |
| Potassium bromide | 6.0 g |
| 5-Methylbenzotriazole | 0.6 g |
| Water to make | 1.0 l |
| pH was adjusted to 12.0 with potassium hydroxide. | |

The results obtained are shown in Table 2 below.

TABLE 2

| Compound of formula (I) | | | Results | | |
|---|---|---|---|---|---|
| Sample | Structure | Level of addition (mol/mol-Ag) | Dot quality | Screen tone | Remarks |
| 201 | — | — | 4.0 | 1.18 | Comparative |
| 202 | (3) | $4.0 \times 10^{-3}$ | 4.5 | 1.30 | Invention |
| 203 | (16) | $1.5 \times 10^{-3}$ | 5.0 | 1.44 | Invention |
| 204 | (18) | $1.5 \times 10^{-3}$ | 4.5 | 1.41 | Invention |
| 205 | (28) | $1.5 \times 10^{-3}$ | 4.5 | 1.43 | Invention |
| 206 | (34) | $3.0 \times 10^{-3}$ | 4.5 | 1.32 | Invention |
| 207 | (c) | $4.0 \times 10^{-3}$ | 4.0 | 1.20 | Comparative |
| 208 | (d) | $4.0 \times 10^{-3}$ | 3.0 | 1.25 | Comparative |
| 209 | (e) | $4.0 \times 10^{-3}$ | 4.0 | 1.21 | Comparative |
| 210 | (f) | $4.0 \times 10^{-3}$ | 3.0 | 1.18 | Comparative |

In Table 2, the dot quality was evaluated on a 5-point scale by visual inspection. The score "5" indicates the best quality and the score "1" indicates the poorest quality. For photoengraving purposes, only a score of 4.0 or greater is acceptable.

The screen tone is the difference between the logarithms of the amounts of exposure giving 5% and 95% blackened areas of the respective dots and the larger the difference, the softer is the screen tone.

It is clear from Table 2 that the use of the compound of formula (I) according to the present invention gives a more satisfactory dot quality and a softer screen tone as compared with other compounds.

While the invention has been described in detail and with reference to specific embodiments thereof, it will be apparent to one skilled in the art that various changes and modifications can be made therein without departing from the spirit and scope thereof.

What is claimed is:

1. A silver halide photographic material containing a compound represented by formula (I)

$$\text{RED}\text{-}(\text{L}_1)_v\text{B}\text{-}(\text{L}_2)_w\text{PUG} \qquad \text{(I)}$$

wherein RED represents a group adapted to release the group $\text{-}(\text{L}_1)_v\text{B}\text{-}(\text{L}_2)_w\text{PUG}$ upon oxidation: $\text{L}_1$ represents a group adapted to release the group $\text{B}\text{-}(\text{L}_2)_w\text{PUG}$ after cleavage from RED; B represents a group which, after cleavage of the bond with $\text{L}_1$ or RED, releases the group $\text{-}(\text{L}_2)_w\text{PUG}$ upon reaction with an oxidized developing agent; $\text{L}_2$ represents a group which, after cleavage from B, releases PUG; PUG represents a photographically useful group; and v and w each represents 0 or 1.

2. A silver halide photographic material as in claim 1, wherein the group represented by RED in formula (I) is a group represented by formula (II)

$$\text{A}_1\text{—P}\text{-}(\text{X}=\text{Y})_n\text{Q—A}_2 \qquad \text{(II)}$$

wherein P and Q each represents an oxygen atom or a substituted or unsubstituted imino group, and at least one of the n occurrences of X and the n occurrences of Y represents a methine group having $-(L_1)_v-B-(L_2)_w-$PUG as a substituent, and the other occurrences of X and Y each represents a substituted or unsubstituted methine group or a nitrogen atom; n is an integer of 1 to 3; $A_1$ and $A_2$ each represents a hydrogen atom or a group capable of removed with alkali.

3. A silver halide photographic material as in claim 2; wherein P and Q each represents a substituted or unsubstituted imino group substitituted by a sulfonyl or acryl group and are represented by the formula

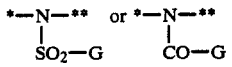

wherein * denotes the position of attachment to $A_1$ to $A_2$ and ** denotes the position of attachment to one of the available valences of $-(X=Y)_n-$ and G represents straight-chain or branched-chain, acyclic or cyclic, saturated or unsaturated, and substituted or unsubstituted aliphatic groups having from 1 to 32 carbon atoms, substituted or unsubstituted aromatic groups having from 6 to 10 carbon atoms, 4- to 7-membered heterocyclic group in which the hetero atom or atoms are selected from nitrogen, sulfur, and oxygen atoms.

4. A silver halide photographic material as in claim 2, wherein RED is represented by formula (III)

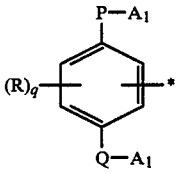

(III)

wherein * denotes the position of attachment of $-(L_1)_v-B-(L_2)_w-$PUG; and P, Q, $A_1$, and $A_2$ have the same meanings as defined for formula (II), and R represents a substituent group and "q" represents an integer of 0, 1, or 3.

5. A silver halide photographic material as in claim 2, wherein RED is represented by formula (IV)

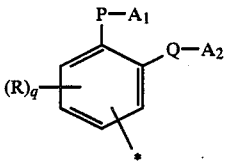

(IV)

wherein * denotes the position of attachment of $-(L_1)_v-B-(L_2)_w-$PUG; and P, Q, $A_1$, and $A_2$ have the same meanings as defined for formula (II), and R represents a substituent group and q represents an integer of 0, 1, or 3.

6. A silver halide photographic material as in claim 4, wherein the RED moiety represented by formula (III) is represented by formula (V)

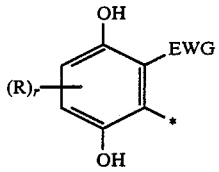

(V)

wherein * denotes the position of attachment of $-(L_1)_v-B-(L_2)_w-$PUG; R has the same meaning as defined for formulae (III); r represents 0, 1 or 2; and EWG represents an electron withdrawing substituent group, or when r is equal to 2 and the two occurrences of R represent adjacent substituents, said substituents may form a fused ring structure.

7. A silver halide photographic material as in claim 5, wherein the RED moiety represented by formula (IV) is represented by formula (VI)

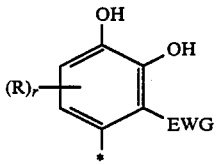

(VI)

wherein * denotes the position of attachment of $-(L_1)_v-B-(L_2)_w-$PUG; R has the same meaning as defined for formulae (III); r represents 0, 1 to 2; and EWG represents an electron withdrawing substituent group, or when r is equal to 2 and the two occurrences of R represent adjacent substituents, said substituents may form a fused ring structure.

8. A silver halide photographic material as in claim 1, wherein B represents a group which provides a coupler and is selected from the groups represented by formulae(Cp-1), (Cp-2), (Cp-3), (Cp-4), (Cp-5), (C-6), (Cp-7), (Cp-8), (Cp-9), (Cp-10), and (Cp-11)

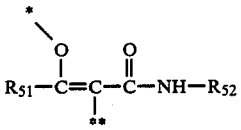

(Cp-1)

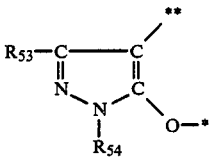

(Cp-2)

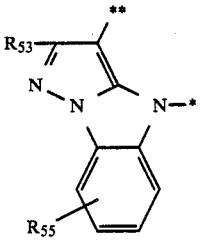

(Cp-3)

-continued (Cp-4)

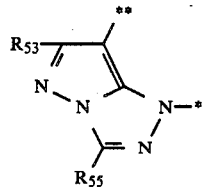

(Cp-5)

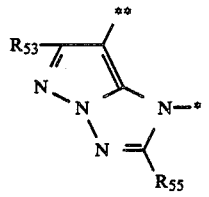

(Cp-6)

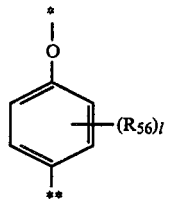

(Cp-7)

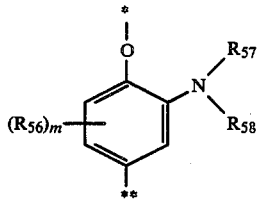

(Cp-8)

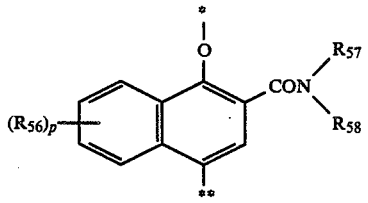

(Cp-9)

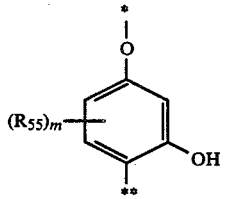

(Cp-10)

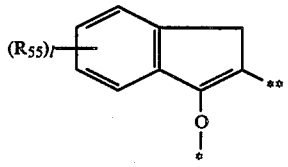

(Cp-11)

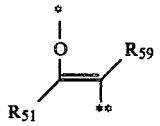

wherein

* denotes the position of attachment to RED-(L1)v;

** denotes the position of attachment to (L2)wPUG;

$R_{51}$ represents an aliphatic, aromatic, or heterocyclic group;

$R_{52}$ represents an aromatic or heterocyclic group;

$R_{53}$ represents a hydrogen atom, a straight-chain or branched-chain alkyl or alkenyl group having from 1 to 32 carbon atoms, a cyclic alkyl group, an aralkyl group, or a cyclic alkenyl group, an aryl group or a heterocyclic group, an alkoxycarbonyl group, an aryloxycarbonyl group, an aralkyloxycarbonyl group, an alkoxy group, an aryloxy group, an alkylthio group, an arylthio group, a carboxyl group, an acylamino group, a diacylamino group, an N-alkylacylamino group, an N-arylacylamino group, a ureido group, a urethane group, a thiourethane group, an arylamino group, an alkyl-amino group, a cycloamino group, a dialkylamino group, a heterocyclic-amino group, an alkylcarbonyl group, an aryl-carbonyl group, a sulfonamido group, a carbamoyl group, a sulfamoyl group, a cyano group, a hydroxy group, or a sulfo group;

$R_{54}$ represents a straight-chain or branched-chain alkyl group or alkenyl group having from 1 to 32 carbon atoms, a cyclic alkyl group, an aralkyl group, a cyclic alkenyl group, an aryl group, or a heterocyclic group;

$R_{55}$ represents a hydrogen atom or a straight-chain or branched-chain alkyl or alkenyl group having from 1 to 32 carbon atoms, a cyclic alkyl group, an aralkyl group, or a cyclic alkenyl group;

$R_{56}$ represents a hydrogen atom, a halogen atom, an alkoxycarbonylamino group, an aliphatic hydrocarbon group, a sulfonamido group, an N-arylureido group, an acylamino group, —O—$R_{60}$ or —S—$R_{60}$, wherein $R_{60}$ is an aliphatic hydrocarbon group, and when $R_{56}$ exists in 2 or more occurrences, they may be the same or different;

$R_{57}$ and $R_{58}$ each represents an aliphatic hydrocarbon group, or one of $R_{57}$ and $R_{58}$ represents a hydrogen atom, and $R_{57}$ and $R_{58}$ may together represent a nitrogen-containing heterocyclic nucleus.

9. A silver halide photographic material as in claim 1, wherein $L_1$ of formula (I) represents

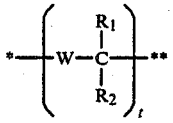

wherein

* denotes the position of attachment of RED- of formula (I);

** denotes the position of attachment of —B-(L2)w-PUG of formula (I);

w represents an oxygen atom or a group

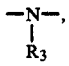

wherein $R_3$ represents a group selected from the group consisting of an acyl group, a sulfonyl group, an aliphatic group and a carbamoyl group;

$R_1$ and $R_2$ each represents a hydrogen atom or a group selected from the group consisting of an acyl group, a carbamoyl group and an aliphatic group;

t represents 1 or 2, and when t is 2, the two occurrences of each of $R_1$ and $R_2$ represent the same or different groups; and $R_1$, $R_2$ and $R_3$ can be combined to form a cyclic structure.

10. A silver halide photographic material as in claim 1, wherein $L_2$ of formula (I) represents

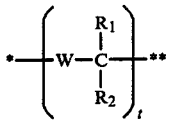

wherein

* denotes the position of attachment of RED-(-$L_1$)-$_v$B— of formula (I);

** denotes the position of attachment of -PUG of formula (I);

W represents an oxygen atom or a group

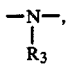

wherein $R_3$ represents a group selected from the group consisting of an acyl group, a sulfonyl group, an aliphatic group and a carbamoyl group;

$R_1$ and $R_2$ each represents a hydrogen atom or a group selected from the group consisting of an acyl group, a carbamoyl group and an aliphatic group;

t represents 1 to 2, and when t is 2, the two occurrences of each of $R_1$ and $R_2$ represent the same or different groups; and $R_1$, $R_2$ and $R_3$ can be combined to form a cyclic structure.

11. A silver halide photographic material as in claim 1, wherein $L_1$ of formula (I) represents a group wherein cleavage is induced by intramolecular nucleophilic substitution reaction.

12. A silver halide photographic material as in claim 1, wherein $L_2$ of formula (I) represents a group wherein cleavage is induced by intramolecular nucleophilic substitution reaction.

13. A silver halide photographic material as in claim 1, wherein $L_1$ of formula (I) represents

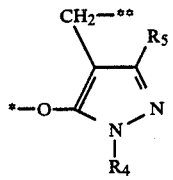

wherein

* denotes the position of attachment of RED- of formula (I);

** denotes the attachment of —B-(-$L_2$)-$_w$PUG of formula (I);

$R_4$ represents a hydrogen atom or a group selected from the group consisting of an aliphatic group and an aromatic group; and $R_5$ represents a hydrogen atom or a group selected from the group consisting of an aliphatic group, an aromatic group and an alkoxycarbonyl group.

14. A silver halide photographic material as in claim 1, wherein $L_2$ of formula (I) represents

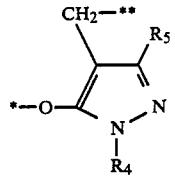

wherein

* denotes the position of attachment of RED-(-$L_1$)-$_v$B of formula (I);

** denotes the position of attachment of -PUG of formula (I);

$R_4$ represents a hydrogen atom or a group selected from the group consisting of an aliphatic group and an aromatic group; and $R_5$ represents a hydrogen atom or a group selected from the group consisting of an aliphatic group, an aromatic group and an alkoxycarbonyl group.

15. A silver halide photographic material as in claim 1, wherein said silver halide photographic light-sensitive material is a multi-layer color photographic element comprising a support having thereon at least two color-sensitive emulsion layers having different spectral sensitivities, and PUG of formula (I) is a development inhibitor or a fogging agent and the compound of formula (I) is used in an amount of from $1\times10^{-7}$ to $5\times10-1$ moles per mole of silver halide associated therewith.

16. A silver halide photographic material as in claim 1, wherein said silver halide photographic light-sensitive material is a multi-layer color photographic element comprising a support having thereon at least two color-sensitive emulsion layers having different spectrosensitivities, and PUG of formula (I) is a development inhibitor or a fogging agent and the compound of formula (I) is used in an amount of from $1\times10^{-6}$ to $1\times10^{-1}$ moles per mole of silver halide associated therewith.

17. A silver halide photographic material as in claim 1, wherein said silver halide photographic light-sensitive material is a multi-layer color photographic element comprising a support having thereon at least two color-sensitive emulsion layers having different spectrosensitivities, and PUG of formula (I) is a photographically useful compound other than a development inhibitor or a fogging agent, and the compound of formula (I) is present in a range of from $1\times10^{-4}$ to $1\times10^{-1}$ mole per mole of silver halide associated therewith.

18. A silver halide photographic material as in claim 1, wherein said silver halide photographic light-sensitive material is a multi-layer color photographic element comprising a support having thereon at least two color-sensitive emulsion layers having different spectrosensitivities, and PUG of formula (I) is a photographically useful compound other than a development inhibitor or a fogging agent, and the compound of formula (I) is present in a range of from $1\times10^{-3}$ to 1 mole per mole of silver halide associated therewith.

19. A silver halide photographic material as in claim 1, wherein said material comprises a silver chlorobromide or silver iodochlorobromide emulsion layer containing at least 60% silver chloride and up to 5% silver iodide and further contains a polyalkylene oxide, and the compound of formula (I) is used in a range of from $1\times10^{-7}$ moles to $1\times10^{-1}$ moles per mole of silver halide associated therewith.

20. A silver halide photographic material as in claim 1, wherein said material comprises a mono-dispersed silver halide emulsion capable of forming an ultra-hard negative image with the use of a stable developer solution through the action of a hydrazine derivative, and the compound of formula (I) is used in a range of from $1\times10^{-5}$ moles to $8\times10^{-2}$ moles per mole of silver halide associated therewith.

21. A silver halide photographic material as in claim 1, wherein B in formula (I) is not a coupler group, and the material comprises a support having on at least one side thereof a sliver iodobromide or silver iodochlorobromide emulsion layer containing up to 50 mole% silver chloride and up to 15 mole% silver iodide, wherein the compound of formula (I) is used in a range of from $1\times10^{-6}$ moles to $1\times10^{-1}$ moles per mole of silver halide associated therewith.

* * * * *